US007299753B2

(12) United States Patent
Strong

(10) Patent No.: US 7,299,753 B2
(45) Date of Patent: Nov. 27, 2007

(54) TABLE

(76) Inventor: L. Curtis Strong, 65 N. 250 West, Clearfield, UT (US) 84015

( * ) Notice: Subject to any disclaimer, the term of this patent is extended or adjusted under 35 U.S.C. 154(b) by 0 days.

(21) Appl. No.: 11/142,017

(22) Filed: Jun. 1, 2005

(65) Prior Publication Data

US 2005/0274304 A1 Dec. 15, 2005

Related U.S. Application Data

(60) Provisional application No. 60/576,788, filed on Jun. 2, 2004.

(51) Int. Cl.
*A47B 3/00* (2006.01)

(52) U.S. Cl. ..... 108/115

(58) Field of Classification Search ..... 248/166, 248/170; 108/115, 124, 127, 166, 167, 169, 108/171, 174, 179, 69, 77
See application file for complete search history.

(56) References Cited

U.S. PATENT DOCUMENTS

| | | | | | |
|---|---|---|---|---|---|
| 318,298 | A | * | 5/1885 | Roberts | 108/124 |
| 643,511 | A | | 2/1900 | Lloyd | |
| 1,614,187 | A | | 1/1927 | Coggins | |
| 1,765,766 | A | | 6/1930 | Lyon | |
| 1,976,140 | A | | 10/1934 | Paul | |
| 2,055,007 | A | * | 9/1936 | Erpelding | 108/124 |
| 2,542,394 | A | | 2/1951 | Cohen et al. | |
| 2,563,891 | A | * | 8/1951 | Wallance | 108/79 |
| 2,619,394 | A | | 11/1952 | Mahr | |
| 2,639,761 | A | * | 5/1953 | Schenzinger et al. | 297/145 |
| 2,696,416 | A | * | 12/1954 | Stedman | 108/79 |
| 2,729,526 | A | * | 1/1956 | Humphrey | 108/79 |
| 2,730,418 | A | | 1/1956 | Blink | |
| 2,747,957 | A | | 5/1956 | Lencioni | |
| 2,871,076 | A | | 1/1959 | Mell | |
| 2,872,259 | A | | 2/1959 | Thorpe | |
| 3,143,982 | A | | 8/1964 | Blink et al. | |
| 3,246,614 | A | * | 4/1966 | Loesch | 108/63 |
| 3,368,504 | A | | 2/1968 | Cohen | |
| 3,379,145 | A | * | 4/1968 | Lieberman | 108/166 |
| 3,606,845 | A | * | 9/1971 | Hickman | 108/169 |
| 3,656,439 | A | | 4/1972 | Domin | |

(Continued)

FOREIGN PATENT DOCUMENTS

| | | | |
|---|---|---|---|
| GB | 2059255 | * | 4/1981 |

(Continued)

*Primary Examiner*—Janet M. Wilkens

(57) ABSTRACT

A table may include a table top with a first section that is selectively movable between a use position and a collapsed position, and a second section that is selectively movable between a use position and a collapsed position. The table may also include a first pedestal that is movable between a first position in which the first pedestal supports the first section of the table top in the use position and a second position in which the first section of the table top may be moved between the use position and the collapsed position. The table may include a second pedestal that is movable between a first position in which the second pedestal supports the second section of the table top in the use position and a second position in which the second section of the table top may be move between the use position and the collapsed position.

25 Claims, 12 Drawing Sheets

U.S. PATENT DOCUMENTS

| | | | | |
|---|---|---|---|---|
| D225,501 | S | | 12/1972 | Apple, Jr. |
| 3,866,913 | A | | 2/1975 | Zimmers et al. |
| D241,672 | S | | 9/1976 | Ricca |
| 4,005,898 | A | | 2/1977 | Way |
| D247,080 | S | | 1/1978 | Robinson |
| D247,401 | S | | 3/1978 | Cohen |
| 4,089,522 | A | | 5/1978 | Rock |
| D248,703 | S | | 8/1978 | Morgan, Jr. |
| 4,133,271 | A | | 1/1979 | Carlson |
| D252,965 | S | * | 9/1979 | Petersen ..... D6/430 |
| 4,489,661 | A | | 12/1984 | Fitzgerald |
| 4,653,804 | A | | 3/1987 | Yoo et al. |
| 4,841,877 | A | | 6/1989 | Virtue |
| 4,883,314 | A | | 11/1989 | Sakong |
| 4,911,085 | A | | 3/1990 | Pencoske |
| 5,009,170 | A | | 4/1991 | Spehar |
| 5,154,441 | A | | 10/1992 | White et al. |
| 5,357,872 | A | | 10/1994 | Wilmore |
| 5,377,601 | A | | 1/1995 | Cashen |
| 5,381,740 | A | | 1/1995 | Johnston |
| D355,318 | S | | 2/1995 | Gutgsell |
| 5,421,272 | A | | 6/1995 | Wilmore |
| 5,501,157 | A | | 3/1996 | Westerburgen |
| 5,730,066 | A | | 3/1998 | Auten et al. |
| D408,177 | S | | 4/1999 | Stout |
| D414,626 | S | | 10/1999 | Collins et al. |
| 5,983,807 | A | | 11/1999 | Tarnay et al. |
| 6,000,345 | A | | 12/1999 | Gillotti |
| D420,527 | S | | 2/2000 | Pinch |
| 6,032,585 | A | | 3/2000 | Pinch |
| 6,058,853 | A | | 5/2000 | Pinch |
| 6,112,674 | A | | 9/2000 | Stanford |
| 6,334,400 | B1 | | 1/2002 | Nien |
| 6,454,357 | B1 | | 9/2002 | Foulger |
| 6,494,147 | B1 | * | 12/2002 | Schulte et al. ..... 108/34 |
| D468,135 | S | | 1/2003 | Ashby et al. |
| D479,778 | S | | 9/2003 | Haney et al. |
| 6,629,504 | B2 | | 10/2003 | Stern |
| 6,684,426 | B1 | | 2/2004 | Lin et al. |
| 6,752,091 | B2 | | 6/2004 | Glover et al. |
| 6,763,769 | B2 | * | 7/2004 | Ballendat ..... 108/79 |
| 6,905,166 | B2 | | 6/2005 | Zhurong et al. |
| 2002/0092445 | A1 | | 7/2002 | Glover et al. |
| 2006/0005748 | A1 | * | 1/2006 | Christians ..... 108/115 |
| 2006/0021550 | A1 | * | 2/2006 | Sagol ..... 108/115 |

FOREIGN PATENT DOCUMENTS

| | | | |
|---|---|---|---|
| GB | 2223401 | * | 4/1990 |

* cited by examiner

TABLE

CROSS-REFERENCE TO RELATED APPLICATIONS

This application claims priority to and the benefit of U.S. provisional patent application Ser. No. 60/576,788, filed Jun. 2, 2004, which is incorporated by reference in its entirety.

BACKGROUND OF THE INVENTION

1. Field of the Invention

The present invention generally relates to furniture and, in particular, to tables.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. Because these conventional tables are generally easy to move and relatively portable, these types of tables can often be positioned in an assortment of different configurations and used in a variety of settings. When the tables are no longer needed, the table legs can be moved into the storage position and the tables may be moved or stored. When the legs are in the storage position, the table may require less storage room and allow the table to be more easily carried or transported.

The table top, however, for many conventional banquet tables may retain its size and shape. For example, many known banquet tables have a length between 6 to 10 feet (1.8 to 3 meters) and a width between 3 to 4 feet (0.9 to 1.2 meters). As a result, many conventional banquet tables, even with the legs in the collapsed position, may require a large storage area. This large storage area for each table may be problematic for larger facilities such as hotels, schools and churches because a considerable number of these table may have to be stored. Thus, a big area may be required to store the tables even with the legs in the storage position. In addition, smaller facilities such as restaurants, offices and homes may use one or more conventional banquet tables. These smaller facilities may use banquet tables less frequently, such as during special occasions, holidays and celebrations. Conventional banquet tables, even when the legs are folded, are often too bulky and obstructive to be conveniently used and stored at such smaller facilities. As a result, it is often necessary for both larger and smaller facilities to rent and/or borrow one or more banquet tables when needed. Disadvantageously, this process of renting and/or borrowing banquet tables can be inconvenient, time consuming and costly.

In addition, conventional banquet tables are often very difficult to move or transport from one location to another. For example, many conventional banquet tables are often difficult to move by a single person because of the long length of the table. In addition, the extended length of many conventional banquet tables may preclude the tables from being transported in the trunk or back seat of a typical passenger car. Accordingly, the banquet tables may have to be transported by a truck or trailer, which may be difficult to obtain. Further, because of the long length of the tables, the tables may be difficult to load, position and unload from a trunk or trailer.

It is also known to construct tables that are capable of being folded-in-half. In particular, conventional fold-in-half tables typically include a table top with two sections that are pivotally connected by a hinge. The two sections of the table top may be moved between an unfolded position or use position in which the sections of the table top are generally aligned in the same plane and a folded position in which the two sections are positioned generally adjacent to each other for storage.

Disadvantageously, many conventional fold-in-half tables with foldable table tops are unstable and unable to support a significant amount of weight. For example, the connection of the two sections of the table top for many known fold-in-half tables is relatively weak, which may allow, for example, a portion of the table top to sag. Additionally, the connection of the table top sections for many known fold-in-half tables may also be relatively frail and may break if a significant load or force is applied to the table top. In order to construct a stronger table top, it is known to make the sections of the table tops out of stronger and thicker materials. Undesirably, this may increase the weight of the table top, which may make the table more difficult to carry and move.

Many conventional tables with fold-in-half table tops include two hinges that connect the two sections of the table top. These hinges are often connected to the table top by a plurality of screws that are bored into the table top. Disadvantageously, the structural integrity of the table top may be decreased by the holes created by the plurality of screws, which may allow the table top to collapse or fail. In addition, because the screws are typically individually attached to the table top, this may significantly increase the amount of the time required to construct the table. Further, this may increase the manufacturing time and costs to make the table.

Additionally, many known tables with foldable table tops are often difficult to transport and store because it may be hard to maintain the table top in the closed position, especially for a single person. In particular, the table tops of many known foldable tables can unintentionally swing between the folded and unfolded position while the tables are being moved, positioned and/or stacked. That is, while the table is being moved, the table top may inadvertently move from the folded to the unfolded position. If this occurs, the table may be undesirably dropped, and this may damage the table and/or injure the person carrying the table.

BRIEF SUMMARY OF EMBODIMENTS OF THE INVENTION

A need therefore exists for a table that reduces or eliminates the above-described and other disadvantages and problems.

One aspect is a table that may include a table top and one or more pedestals or other support structures that may be used to support the table top in a use or support position. Advantageously, when the table top is in the use position, the table may be used to support a wide variety of objects and the table may be used for a variety of different purposes.

Another aspect is a table that may include a table top that is capable of being moved between a folded position and an unfolded position. Preferably, the table top includes two portions and the two portions are generally aligned in the same plane when the table top is in the unfolded position and the two portions are generally positioned adjacent to each other when the table top is in the folded position. This may allow, for example, a single person to easily move and transport the table. In addition, this may allow the table to be positioned in a relatively small area. Further, this may allow one or more tables to be shipped, stacked and/or stored in relatively small areas.

A further aspect is a table that may include a frame and a table top with two sections that are capable of being moved between a folded position and an unfolded position. When the sections of the table top are in the collapsed position, the frame is preferably generally disposed between the first and section sections of the table top. In particular, the frame is preferably disposed between a first plane generally aligned with the first table top section and a second plane generally aligned with the second table top section. Advantageously, this may facilitate shipping, stacking and/or storing the table.

Still another aspect is a table that may include a table top with first and second sections that engage when the table top is in the unfolded or use position. Preferably, an inner portion of the first section engages an inner portion of the second section when the table top is in the unfolded position and the inner portions of the first and second sections are spaced apart when the table top is in the folded position. Advantageously, the inner portions of the first and second sections may be sized and configured to interlock and/or overlap to allow, for example, a secure connection of the first and second sections when the table top is in the unfolded or use position. For instance, the inner portions of the table top sections may include one or more projections and/or recesses that are sized and configured to contact or engage when the table top is in the unfolded or use position. In particular, the inner portions of the table top sections may include tongue and groove portions which engage when the table top is in the unfolded or use position. In greater detail, the inner portion of the first table top section may have one or more tongue and/or groove portions that are aligned with corresponding tongue and/or groove portions in the inner portion of the second table top section. The table top sections are preferably sized and configured so that the tongue and groove portions engage and/or interlock when the table top is in the unfolded or use position. Advantageously, this may increase the strength and rigidity of the table top, which may allow the table top to be constructed of a lighter and/or thinner material without sacrificing strength or integrity.

Yet another aspect is table that may include a table top with first and second sections and a frame with first and second sections. Preferably, the first section of the frame supports the first section of the table top and the second section of the frame supports the second section of the table top. Advantageously, the frame may support the table top when it is in the unfolded or use position and allow the table top to be quickly and easily moved into the folded or collapsed position. In addition, the frame may allow one portion of the table top to be in the use position and the other portion of the table top to be in the collapsed position. This may allow, for example, only a portion of the table to be used at one time.

Yet still another aspect is a table that may include one or more pedestals or support structures. The pedestals may include one or more legs and other components such as connecting members or feet. The pedestals, however, may only consist of the legs, if desired. The pedestals are preferably sized and configured to support the table top above a surface, such as the floor, when the table top is in the unfolded position. Advantageously, the table may include a first pedestal that is connected to or forms a portion of a first section of the frame, and a second pedestal that is connected to or forms a portion of a second section of the frame. The first and second pedestals may support the first and second sections of the table top in the extended or use position, and allow the first and second sections of the table top to be in the collapsed or storage position. The first and second pedestals may also allow one portion of the table top to be in the use position and the other portion of the table top to be in the collapsed position, which may allow only a portion of the table to be used at one time.

A further aspect is a table that may include pedestals that are movable relative to the table top to allow the table top to be moved between the unfolded or use position and the folded or collapsed position. For example, the pedestals may have a first position in which a first section of the table top is supported in a use position and a second position in which the first section of the table top may be disposed in the folded or collapsed position.

Another aspect is a table that may include a table top constructed from plastic and the plastic table top is preferably constructed using a blow-molding process. Advantageously, this may allow a lightweight table top to be constructed and it may allow the table top to be formed into various desired configurations, shapes, sizes and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Significantly, the table top may form a structural member of the table or the table top may be supported by other structures such as a frame.

Advantageously, a table top constructed from blow-molded plastic may be relatively strong because it may include opposing walls or surfaces that are separated by a distance. The opposing walls may help create a high-strength, rigid table top and the opposing walls are preferably separated by a generally constant distance so that the table top has generally uniform characteristics. In addition, because a hollow interior portion may be formed during the blow-molding process, the table top may be lightweight.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to clarify the aspects, advantages, and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

Figure 2:
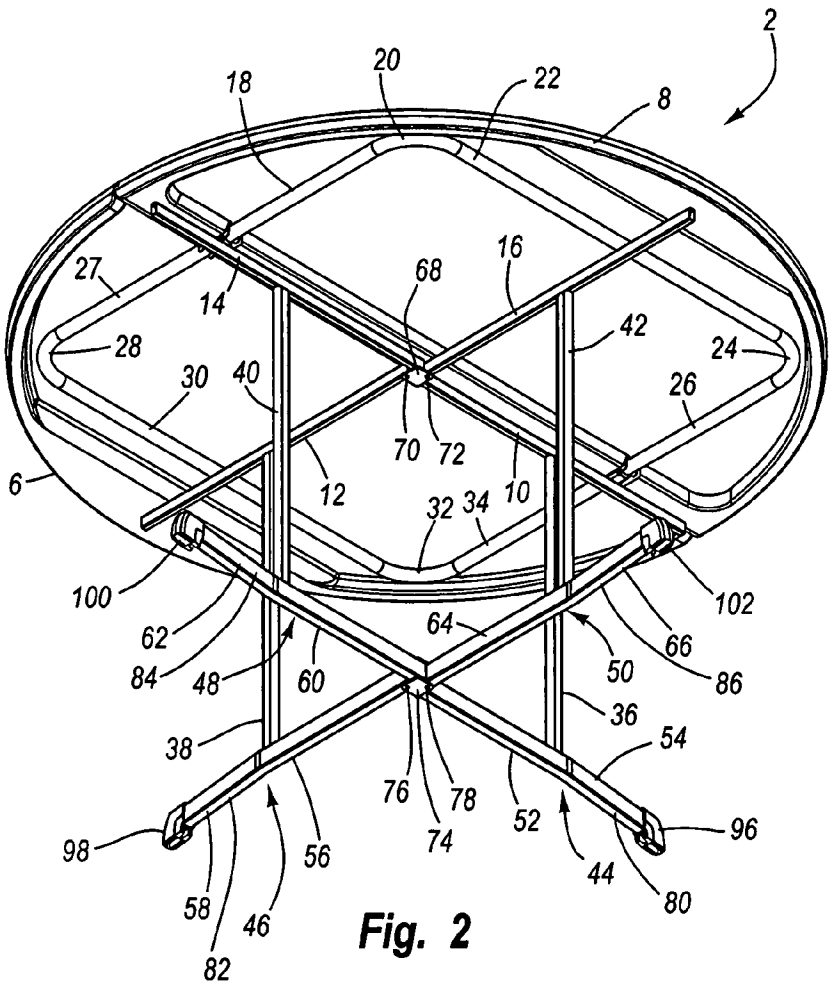
FIG. 2 is a bottom perspective view of the table shown in FIG. 1.
Figure 1:
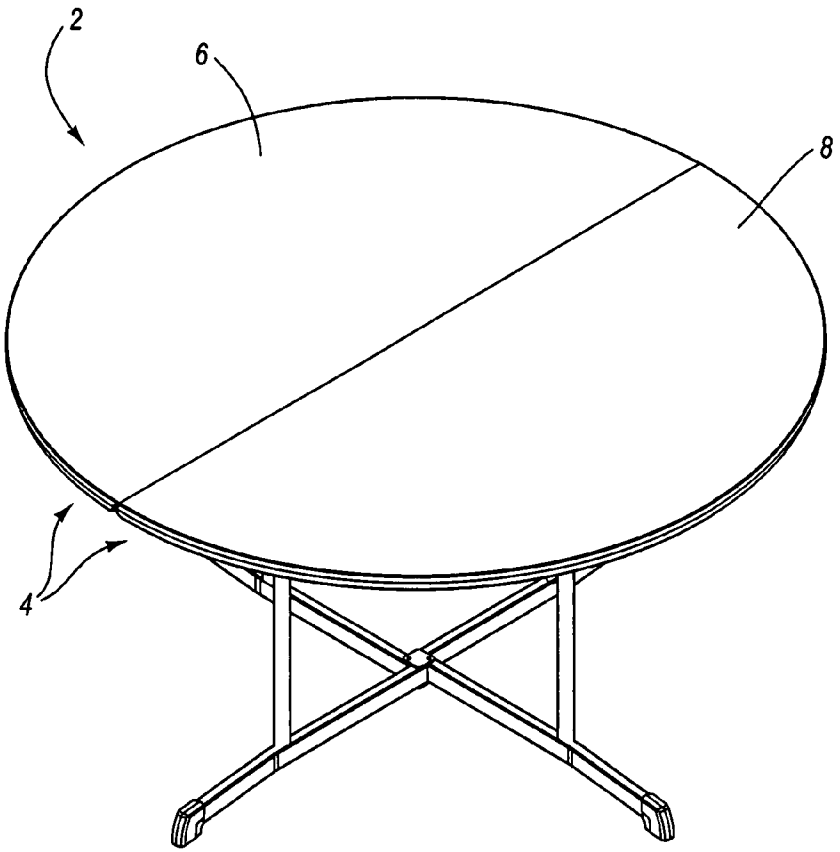
FIG. 1 is a top perspective view of an exemplary embodiment of a table, illustrating a table top with two section that are in an unfolded, extended or use position.
Figure 3:
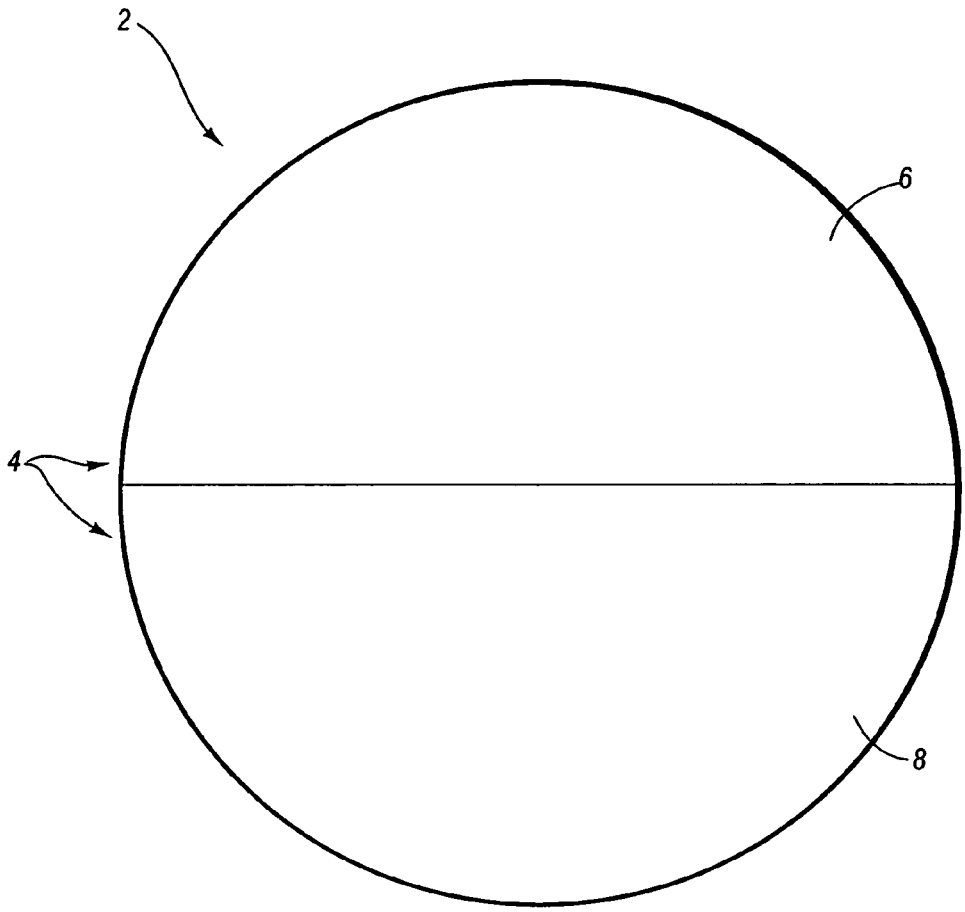
FIG. 3 is a top view of the table shown in FIG. 1.
Figure 4:
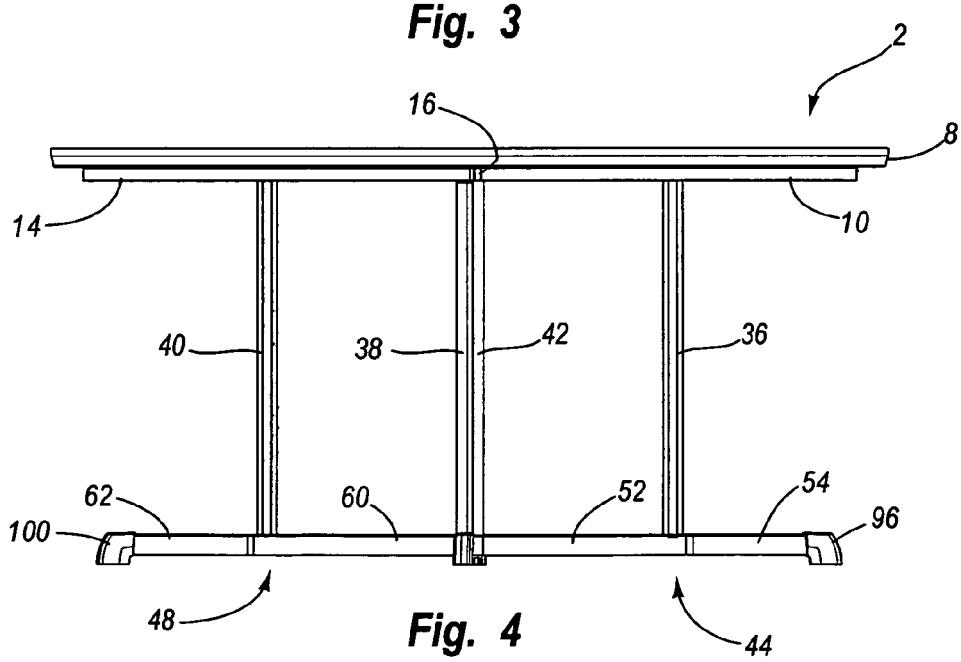
FIG. 4 is a front view of the table shown in FIG. 1.

The present invention is generally directed towards a table. The principles of the present invention, however, are not limited to tables. It will be understood that, in light of the present disclosure, the invention disclosed herein can be successfully used in connection with other types of furniture, fixtures, and equipment.

Additionally, to assist in the description of the table, words such as top, bottom, front, rear, right and left may be used to describe the accompanying figures. It will be appreciated that the present invention can be located in a variety of desired positions—including various angles, sideways and even upside down. A detailed description of the table now follows.

As shown in FIGS. 1-4, an exemplary embodiment of a table 2 may include a table top 4 with a first section 6 and a second section 8. As shown in the accompanying figures and discussed in greater detail below, the first and second sections 6, 8 of the table top 4 may be located in an extended or use position in which the table top section is generally parallel to a support surface, such as a floor, and that section of the table may be used in a similar manner as a conventional table. The first and section sections 6, 8 of the table top 4 may also be located in a collapsed or storage position in which the table top section is not disposed generally parallel to the support surface. While the accompanying figures and following detailed description describe a table top 4 with two sections 6, 8, it will be appreciated that the table top 4 could include any suitable number of sections.

As shown in the accompanying figures, the table 2 may have a generally circular or round table top 4. The round table top 4 preferably has a diameter of about four feet (about 1.2 meters) to about six feet (about 2.4 meters), which may allow a number of people to sit at the table 2. Advantageously, this may allow the table 2 to be used for a wide variety of purposes and functions such as dining, working, meetings, crafting and the like. The table top 4, however, could be larger or smaller, if desired. For example, the table top 4 may be sized and configured for use by an individual. Thus, the table 2 may have a relatively small table top 4 if it is sized and configured for use by a single person. On the other hand, if the table 2 is sized and configured to be used by more than one person, then the table top 4 may have a larger size. In addition, the table 2 and/or table top 4 may be sized and configured for particular uses, such as a computer table, game table, bedside table, night stand, television table, utility table, desk and the like. It will be appreciated that while the table 2 and/or table top 4 could be specifically sized and configured for a particular use or activity, the table could have various suitable sizes, shapes, configurations and arrangements depending upon the intended use of the table or it could have a general shape and design that allows it to be used in a wide variety of situations and circumstances.

The table top 4 may be constructed from a lightweight material such as plastic. Preferably, the table top 4 is constructed from a plastic such as high density polyethylene, but any suitable type of plastic may be used. The plastic table top 4 is desirably formed into the desired size and configuration by a blow-molding process. The blow-molded plastic table top 4 may allow a strong, lightweight, rigid and sturdy table top to be quickly and easily manufactured. In particular, the blow-molded plastic table top 4 may have a lighter weight than conventional table tops constructed from wood or metal and the blow-molded plastic table top may be constructed from less plastic than conventional plastic table tops, which may save manufacturing costs and reduce consumer costs. Further, the blow-molded plastic table top 4 can be manufactured with thinner outer walls than conventional plastic table tops and that may allow the table top to cool faster during the manufacturing process, which decreases the manufacturing time.

The table top 4 is also preferably constructed from blow-molded plastic because the blow-molded plastic table top may be durable, weather resistant, generally temperature insensitive, corrosion resistant and rust resistant. In addition, the blow-molded plastic table top 4 preferably does not deteriorate or weaken over time. It will be appreciated that the table top 4 does not have to be constructed from blow-molded plastic. For example, other suitable materials may be used to construct the table top 4 such as synthetics, composites, wood, metal and the like. It will also be appreciated that the table top 4 could be constructing using other suitable processes such as injection molding, extrusion molded molding, rotational molding and the like. Thus, it will be understood that the table top 4 could be constructed from other materials and/or other processes if desired.

The table top 4 may include one or more features and these features may be integrally formed in the table top as part of a unitary, one-piece structure. For example, the table top 4 may include a generally downwardly extending lip that may be disposed at or near the outer perimeter of the table top. In greater detail, the lip is preferably disposed about the outer periphery of the table top 4 and it is generally aligned with the outer edge of the table top, but the lip could also be spaced inwardly if desired. The lip may also include a hollow interior and the lip may be integrally formed during the blow-molding process as part of table top 4. The lip, however, could have any suitable arrangement or configuration, and the table 2 does not require the lip.

In addition, the table top 4 may include one or more structures or features that may be sized and configured to increase the strength and/or rigidity of the table top. For example, the table top 4 may include one or more depressions, which are also known as tack-offs or kiss-offs, that are sized and configured to increase the strength and/or rigidity of the table top. Advantageously, the depressions may be integrally formed as part of a unitary one-piece table top 4, such as during the blow-molding processes. The depressions are preferably formed in the lower portion of the table top and extend towards the upper portion of the table top. The ends of the depressions may contact or engage the upper portion of the table top or the ends of the depressions may be spaced apart from the upper portion of the table top. The depressions may cover all or just a portion of the lower portion of the table top and the depressions may be arranged into a specific pattern or array, if desired. Additional details regarding the size, shape and configuration of depressions that may suitable for use in connection with the table top 4 are disclosed in Assignee's U.S. Pat. No. 7,069,865, entitled HIGH-STRENGTH, LIGHTWEIGHT BLOW-MOLDED PLASTIC STRUCTURES, which issued on Jul. 4, 2006; and U.S. Pat. No. 7,171,910, entitled HIGH-STRENGTH, LIGHTWEIGHT BLOW-MOLDED PLASTIC STRUCTURES, which issued on Feb. 6, 2007; which are incorporated by reference in their entireties. While the table top 4 preferably includes one or more depressions, it will be appreciated that the table top does not require any depressions or other reinforcing structures. It will also be appreciated that the depressions, if any, could be formed in any desired portions of the table top 4.

As discussed above, the table top 4 preferably includes a first section 6 and a second section 8. As shown in the accompanying figures, the first and second sections 6, 8 preferably have substantially the same size and configuration. In particular, the first and second sections 6, 8 preferably have a generally half-circle configuration, but it will be appreciated that the table top 4 could includes any suitable number of sections and the sections could have any appropriate size, shape and configuration.

The table top 4 may be supported by a frame 9 and the frame may be sized and configured to allow the first and second sections 6, 8 of the table top to move between the extended or use position and the collapsed or storage position. For example, as shown in the accompanying figures, the frame 9 may include four support members 10, 12, 14 and 16 that are interconnected proximate the center of the table top 4. The support members 10, 12, 14, 16 preferably consist of generally straight, elongated rods or bars, but the support members could have other shapes and sizes depending, for example, upon the shape and size of the table top 4.

As discussed in greater detail below, when the support members 10, 12, 14, 16 are disposed in an extended position, the support members may support the first and second sections 6, 8 of the table top 4 in the extended position. On the other hand, when one or more of the support members 10, 12, 14, 16 are disposed in the collapsed or storage position, the first and/or section sections 6, 8 of the table top 4 may also be disposed in the collapsed or storage position.

The table 2 may also include one or more support portions connected to the table top 4. For example, the table 2 may include a first support portion that is connected to the first section 6 of the table top 4 and a second support portion that is connected to the second section 8 of the table top. In greater detail, the first support portion may include five elements 18, 20, 22, 24, 26, which are preferably interconnected and attached to a lower portion of the first section 6 of the table top 4. The second support portion may also include five elements 27, 28, 30, 32, 34, which are preferably interconnected and attached to the lower portion of the second section 8 of the table top 4. The first and second support portions are desirably sized and configured to support the first and second sections 6, 8 of the table top 4, respectively; facilitate attachment of the support members 10, 12, 14, 16 to the table top; and/or facilitate movement of the support members relative to the table top. Advantageously, the support portions may be part of the frame 9 or the support portions could be separate components from the frame. It will be appreciated that the first and second support portions could have other suitable numbers, shapes, sizes and configurations, and the support portions may not be required depending, for example, upon the configuration of the table 2.

In addition, the table 2 may include one or more leg assemblies. As shown in FIGS. 1-4, the table 2 may include four leg assemblies and each leg assembly may include a leg 36, 38, 40, 42 and a foot 44, 46, 48, 50, respectively. The legs 36, 38, 40, 42 preferably consist of generally straight, elongated members that may be sized and configured to support the table top 4 a predetermined distance above a support surface when the table top is in the extended or use position. The feet 44, 46, 48, 50 preferably consist of generally straight, elongated members that may be sized and configured to provide a sturdy base for the table 2. If desired, the leg assemblies may form part of the frame 9 or the leg assemblies could be separate components from the frame. It will be appreciated that the table 2 could include any suitable number of leg assemblies and the leg assemblies could have other suitable shapes, sizes and configurations. It will also be appreciated that the leg assemblies could include any suitable number and configuration of legs, feet and/or other parts and components depending, for example, upon the design of the leg assemblies. Thus, for example, a leg assembly could include more than one leg, foot or the like. It will further be appreciated that leg assemblies may be adjustable in length and that components, such as the feet, are not required.

In greater detail, as shown in FIGS. 1-4, each foot 44, 46, 48, 50 may include a first section 52, 56, 60, 64 and a corresponding second section 54, 58, 62, 66. Desirably, the first section 52, 56, 60, 64 is offset from the corresponding second section 54, 58, 62, 66. For example, the first section 52, 56, 60, 64 may be offset from the corresponding second section 54, 58, 62, 66 by an angle of about 5 degrees, but this angle could be larger or smaller if desired. Advantageously, the offset first section 52, 56, 60, 64 and second section 54, 58, 62, 66 may help create a sturdier base and better stabilize the table 2. In particular, the offset sections may be used to provide a wider or otherwise larger base, which may make the table 2 less likely to inadvertently tip over when, for example, either or both of the sections 6, 8 of the table top 4 are in the collapsed position. Thus, as discussed in more detail below, when all or a portion of the table top 4 is in the collapsed position, the offset sections of the feet 44, 46, 48, 50 may allow the table 2 to be stored in a substantially upright position that is unlikely to tip over or fall. It will be appreciated that the feet 44, 46, 48, 50 could have other suitable shapes, sizes and configurations; and the feet could have any suitable number of sections, but the sections are not required.

As discussed above, the support members 10, 12, 14, 16 may be connected and one or more of the support members may be movable between an extended position and a collapsed position. In greater detail, as shown in FIG. 2, a bracket 68 may be located proximate the center of the table top 4 and the bracket 68 may interconnect the support members 10, 12, 14, and 16. Preferably, the support members 10 and 14 remain in a generally fixed position relative to the table top 4, and the support members 12 and 16 are movable relative to the table top. For example, the support member 12 may be pivotally connected to the bracket 68 by a fastener 70 and the support member 16 may be pivotally connected to the bracket by a fastener 72, and this may allow the support members 12, 16 to be movable relative to the table top. In particular, this may allow the support members 12, 16 to be moved between the extended position and the collapsed position. It will be appreciated that the support members 10, 12, 14, 16 may be connected in any suitable manner, but the support members do not have to be interconnected. It will also be appreciated that one or more of the support members 10, 12, 14, 16 may be held in a generally fixed or movable configuration depending, for example, upon the design or intended use of the table 2.

The feet 44, 46, 48, 50 may also be connected and one or more of the feet may be movable between an extended position and a collapsed position. For example, as shown in FIG. 2, a bracket 74 may interconnect the feet 44, 46, 48, 50. Preferably, the feet 46 and 50 are movable relative to the table top 4, and the feet 44 and 48 remain in a generally fixed position relative to the table top 4. In particular, the foot 46 may be pivotally connected to the bracket 74 by a fastener 76 and the foot 50 may be pivotally connected to the bracket by a fastener 78. Advantageously, this may allow the feet 46 and 50 to be movable relative to the table top 4. It will be appreciated that the feet 44, 46, 48, 50 may be connected in any suitable manner, but the feet do not have to be interconnected. It will also be appreciated that one or more of the feet 44, 46, 48, 50 may be held in a generally fixed or movable configuration depending, for example, upon the design or intended use of the table 2.

The table 2 may also include one or more pedestals or support structures and the pedestals may include one or more of the components discussed above or other components. For example, the table 2 may include four pedestals and each pedestal may include an upper portion formed by the support members 10, 12, 14, 16; a body portion formed by the legs 36, 38, 40, 42; and a lower portion formed by the feet 44, 46, 48, 50, respectively. It will be appreciated that the pedestals could have other suitable components, configurations, arrangements and the like.

In greater detail, as shown in FIG. 2, the table 2 may include a first pedestal 80 including the support member 10, the leg 36 and the foot member 44; a second pedestal 82 including the support member 12, the leg 38 and the foot member 46; a third pedestal 84 including the support member 14, the leg 40 the foot member 48; and a fourth pedestal 86 including the support member 16, the leg 42 and the foot member 50. These components are preferably connected by fasteners, adhesives, welding and the like. Advantageously, the pedestals may provide a strong support for the table top 4, which may allow the table top to hold a larger amount of weight.

One or more of the pedestals are preferably movable relative to the table top 4. For example, the first pedestal 80 and the third pedestal 84 preferably remain in a generally fixed position, and the second pedestal 82 and the fourth pedestal 86 are preferably movable between an extended position and a collapsed position relative to the table top 4. In particular, the first pedestal 80 and the third pedestal 84 may be securely attached to the table top 4 in a generally fixed position, and the second pedestal 82 and the fourth pedestal 86 may be movable relative to the table top. Thus, the second pedestal 82 and the fourth pedestal 86 may be moved between an extended position in which the first and second sections 6, 8 of the table top 4 are supported in the extended position, and a collapsed position in which the first and section sections of the table top may be collapsed.

Figure 6:
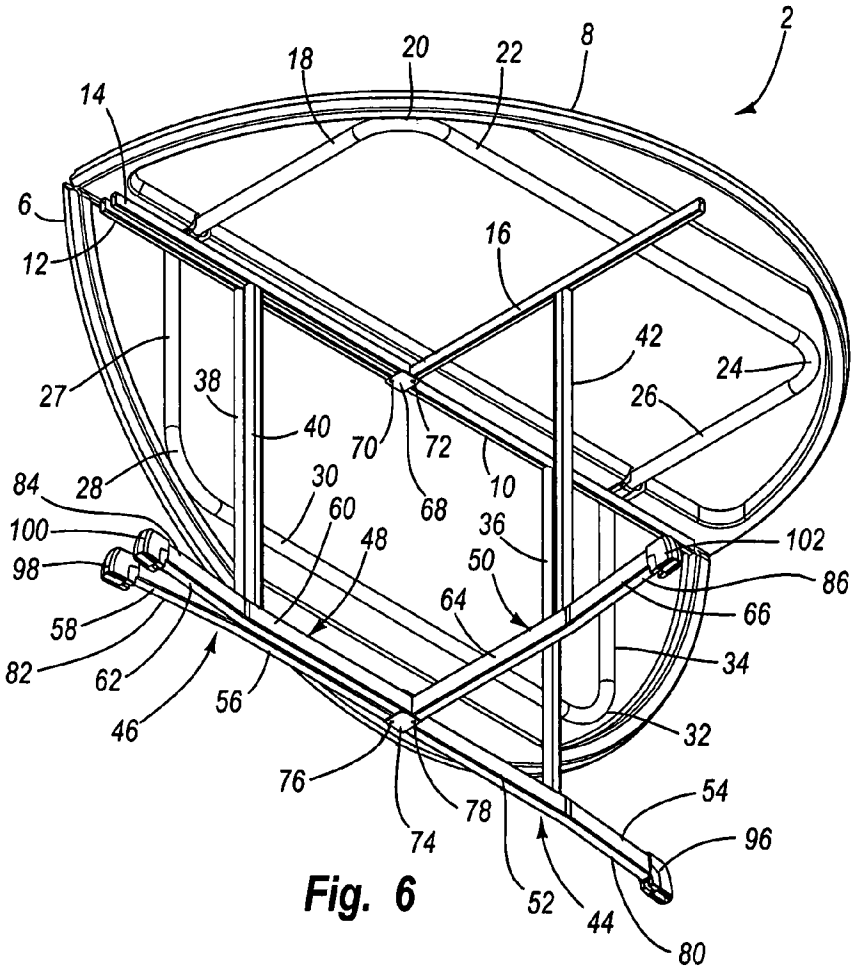
FIG. 6 is a bottom perspective view of the table shown in FIG. 5.
Figure 5:
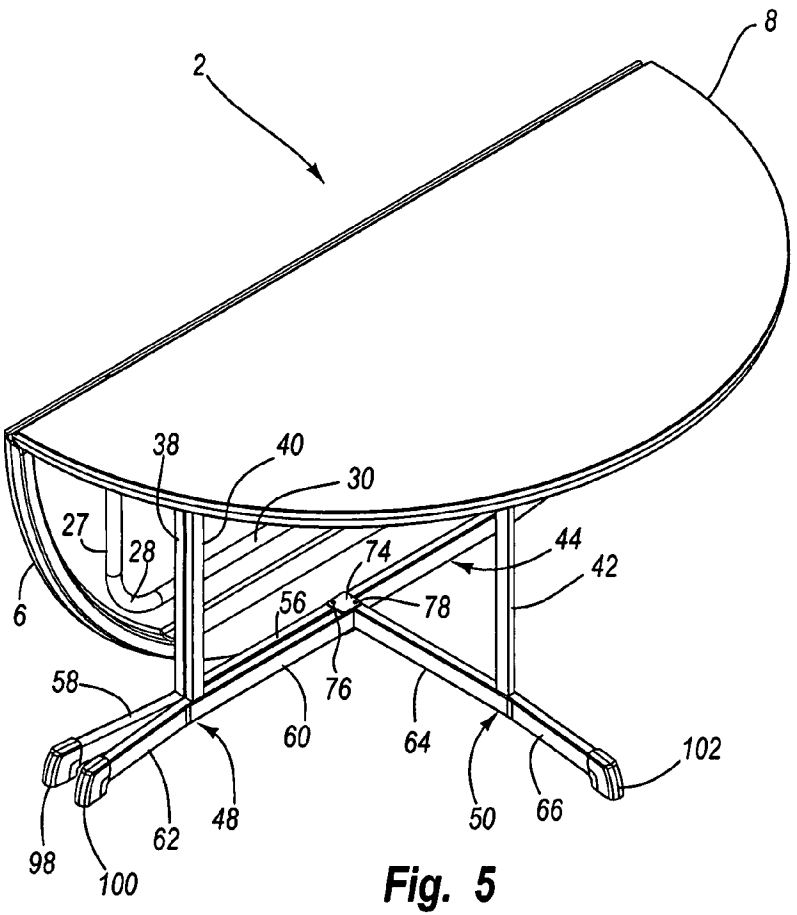
FIG. 5 is a top perspective view of the table shown in FIG. 1, illustrating one section of the table top in the extended position and another section of the table top in a folded or collapsed position.
Figure 7:
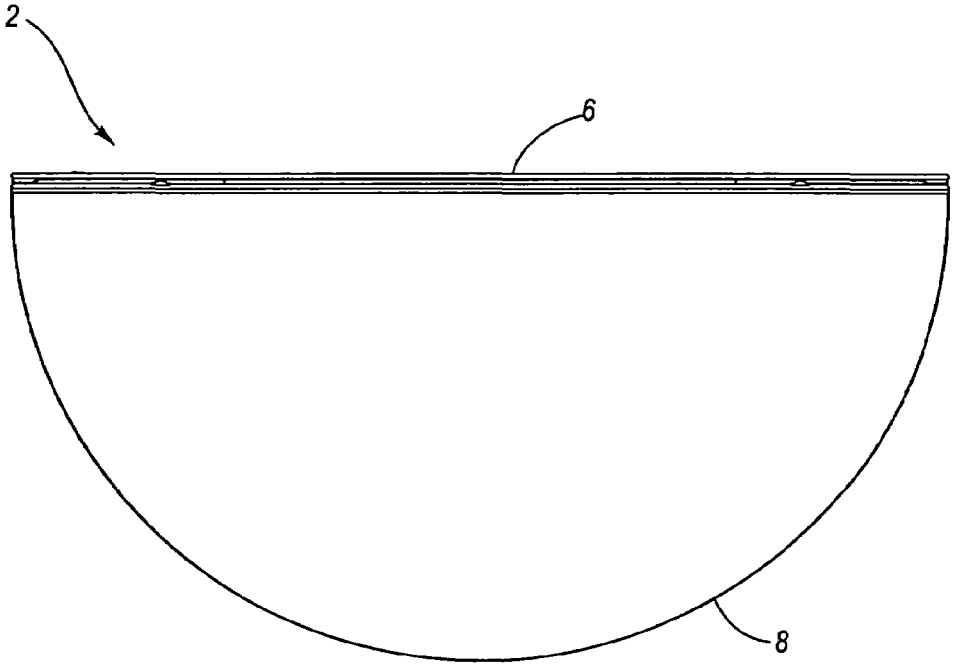
FIG. 7 is a top view of the table shown in FIG. 5.
Figure 8:
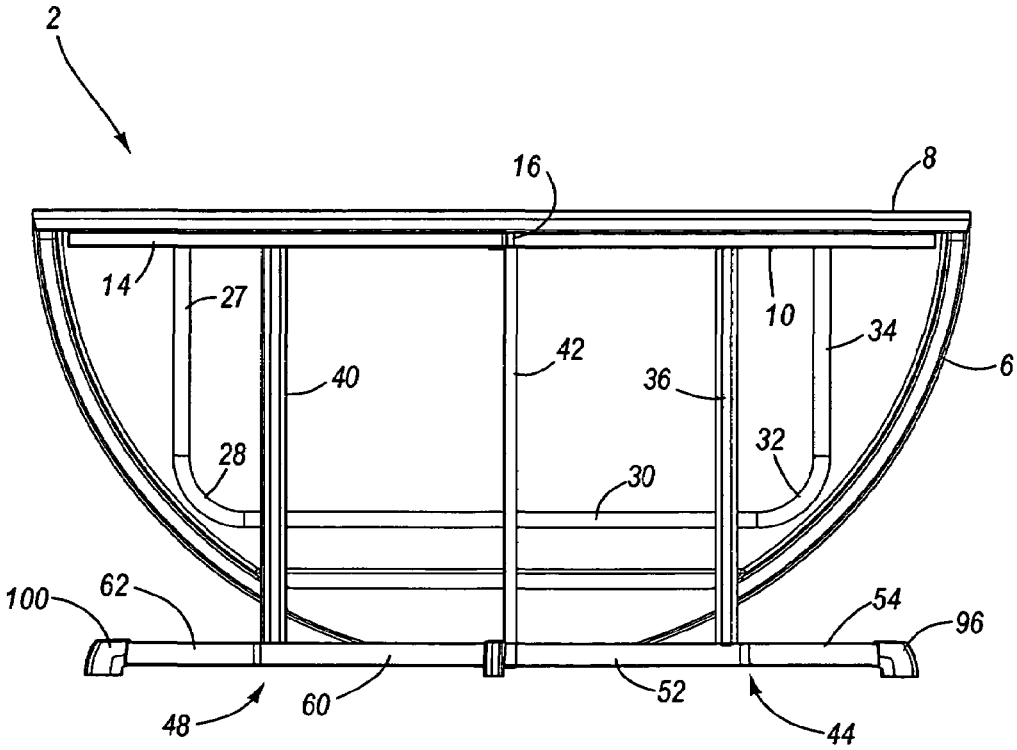
FIG. 8 is a front view of the table shown in FIG. 5.
Figure 10:
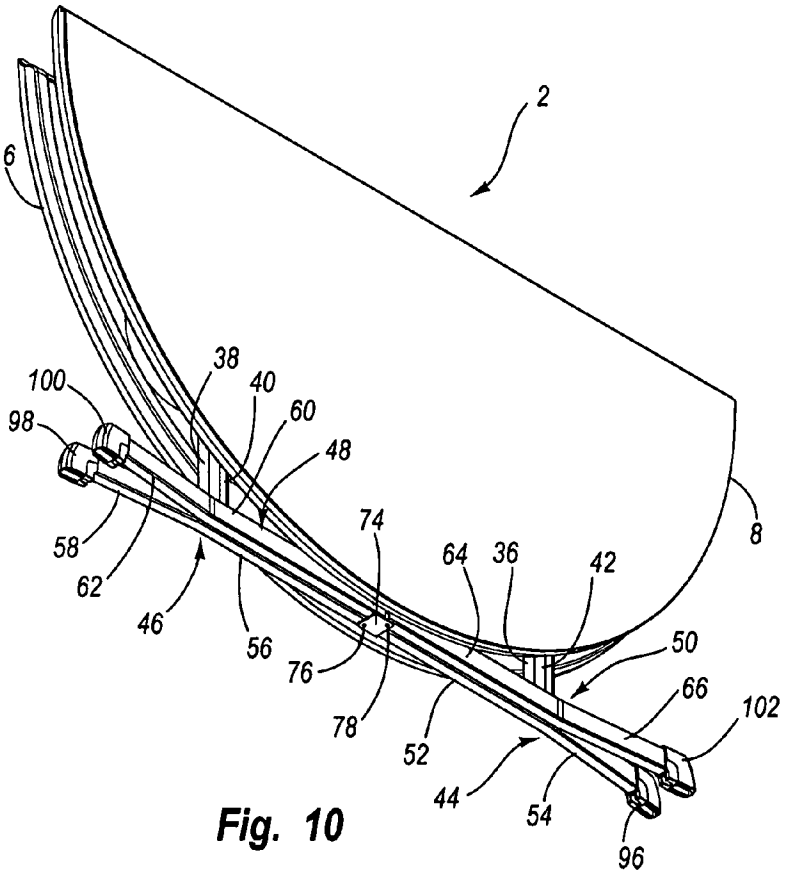
FIG. 10 is a bottom perspective view of the table shown in FIG. 9.
Figure 9:
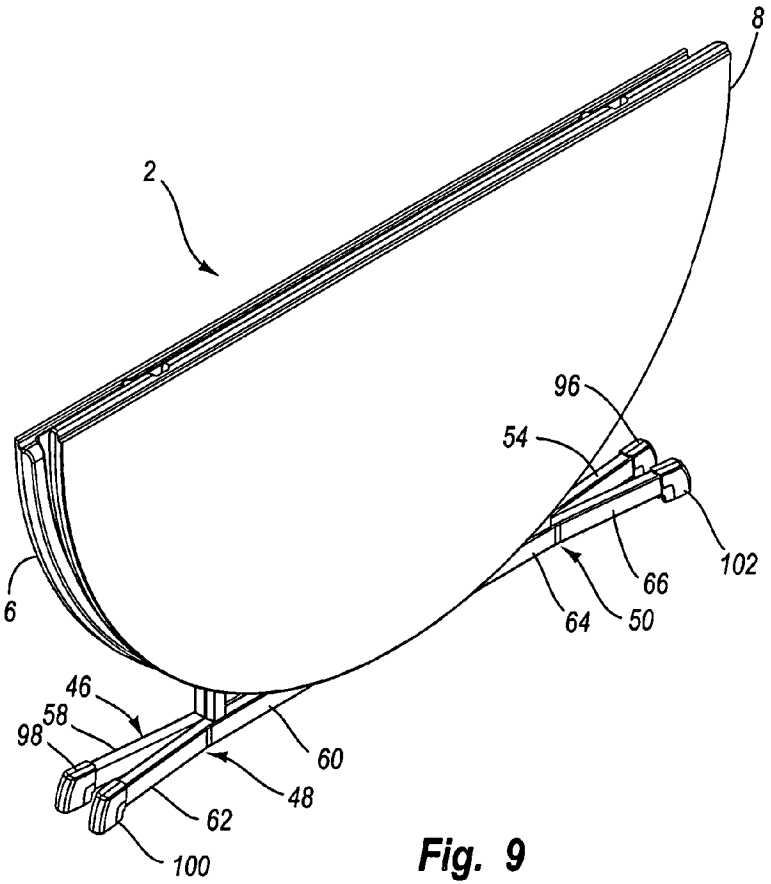
FIG. 9 is a top perspective view of the table shown in FIG. 1, illustrating both sections of the table top in the folded or collapsed positions.

In greater detail, as shown in FIG. 2, the second pedestal 82 may support the first section 6 of the table top 4 in the extended position and the fourth pedestal 86 may support the second section 8 of the table top in the extended position. As best seen in FIG. 6, the second pedestal 82 may be moved into the collapsed position, which may allow the first section 6 of the table top 4 to be moved into the collapsed position. Advantageously, as seen in FIGS. 5-8, when the second pedestal 82 and the first section 6 of the table top 4 are in the collapsed positions, the fourth pedestal 86 and the second section 8 of the table top may remain in the extended or use positions. Significantly, this may allow a portion of the table top 4 to be disposed in the collapsed position and another portion of the table top to be disposed in the extended or use position. It will be appreciated that either the first section 6 of the table top 4 and the second pedestal 82 and/or the second section 8 of the table top and the fourth pedestal 86 may be in the extended or collapsed positions. This may increase the functionality and potential uses of the table 2. It will also be appreciated that the pedestals 80, 82, 84, 86 may have other suitable numbers, configurations, arrangements and designs depending, for example, upon the size and configuration of the table top 4 and/or the intended use of the table 2. The pedestals 80, 82, 84, 86 are preferably constructed from a relatively strong and lightweight material such as steel. The pedestals 80, 82, 84, 86 may be finished, for example by painting or powder coating, to protect the pedestals from the elements. Advantageously, the steel pedestals 80, 82, 84, 86 may help create a table 2 that is strong and able to support a relatively large amount of weight. In greater detail, the pedestals 80, 82, 84, 86 are preferably constructed from steel tubes with a generally circular, square, rectangular or oblong cross-section. It will be appreciated that the pedestals 80, 82, 84, 86 could also be constructed from other materials with suitable characteristics and the pedestals could have other configurations, arrangements and designs, if desired. It will also be appreciated the pedestals 80, 82, 84, 86 could also be constructed from a variety of different materials and/or processes. For example, as discussed above, the pedestals 80, 82, 84, 86 may include the support members 10, 12, 14, 16; the legs 36, 38, 40, 42; and the feet 44, 46, 48, 50, respectively. These various components may be constructed from the same or different materials and processes; and these components may have a variety of appropriate shapes, sizes, configurations, arrangements and designs.

As discussed above, the table 2 may include various features, functions and components, if desired, and these features, functions and components may be configured into a variety of different arrangements. For example, the table 2 could also use the support structure as shown in FIGS. 13-24. Because the support structure shown in FIGS. 13-24 is similar to the support structure shown in FIGS. 1-12, the same references numbers are used in connection with similar components for clarity and ease of reference. It will be understood, however, the support structure shown in FIGS. 13-24 may have other suitable shapes, sizes, configurations, arrangements and designs depending, for example, upon the size and shape of the table top or the intended use of the table.

The support structure shown in FIGS. 13-24 preferably has pedestals 80, 82, 84, 86 similar to those shown in FIGS. 1-12. In addition, the first and second support portions, which include the elements 18, 20, 22, 24, 26 and 27, 28, 30, 32, 34, respectively, may be connected to the support members 10, 12, 14, 16. This may allow, for example, the first and second support portions to form part of the frame, if desired.

The first and second support portions are preferably pivotally connected to facilitate movement of the first and second sections 6, 8 of the table top 4 to be moved between the extended and collapsed positions. For example, the first and second support portions may be pivotally connected by four links 88, 90, 92, 94. Advantageously, the links 88, 90, 92, 94 may allow the first and second support portions to be quickly and easily moved between the extended and collapsed positions. It will be appreciated that the first and second support portions could also be connected by other suitable devise in other suitable manners.

As discussed above, the first section 6 of the table top 4 is preferably supported by the first support portion and the second section 8 of the table top is preferably supported by the second support portion. Preferably, the first and second support portions are directly connected to the table top 4, but it will be appreciated that the support portions may be connected to the table top in any suitable manner. Advantageously, all or a portion of the first support portion and the second support portion may be disposed within one or more recesses formed in the lower portion of the table to 4. The recesses may help hide all or a portion of the first support portion and the second support portion from view. Accordingly, manufacturing blemishes and imperfections may be at least partially hidden by the table top 4.

The table 2 may also include other features or components such as end caps 96, 98, 100 and 102. The end caps 96, 98, 100, 102 are preferably connected to the outer ends of the feet 44, 46, 48, 50 and the end caps preferably include a lower portion that is sized and configured to contact a support surface such as a floor. Advantageously, the end caps 96, 98, 100, 102 may prevent the support surface from being inadvertently being marred or scratched by the feet 44, 46, 48, 50 and the end caps may help hold the table 2 in a generally stationary position. The end caps 96, 98, 100 and 102 may be constructed from relatively pliable and resilient materials such as rubber or plastic, but the end caps may also be constructed from other suitable materials.

Advantageously, the end caps 96, 98, 100, 102 and/or the offset sections 52, 54, 56, 58, 60, 62, 64, 66 of the feet 44, 46, 48, 50 may help create a stable and steady base for the table 2, especially when one or both of the sections 6, 8 of the table top 4 are in the collapsed position. For example, as shown in FIGS. 5-12 and 17-24, when the second and/or fourth pedestals are in the collapsed positions, the ends of the feet and/or the end caps may be spaced apart to form a wider, more stable base. In particular, when both the first section 6 and the second section 8 of the table top 4 are in the collapsed position as shown in FIGS. 9-12 and 21-24, the ends of the feet and the end caps are spaced part. Thus, even when the table top 4 is in the completely collapsed position, the pedestals 80, 82, 84, 86 may still support the table 2 in a stable manner. Preferably, as best seen in FIGS. 9-12 and 21-24, when the table top 4 and the pedestals 80, 82, 84, 86 are in the collapsed positions, the ends of the feet 44, 46, 48, 50 and/or the end caps 96, 98, 100, 102 do not extend beyond a plane generally aligned with the first and second sections 6, 8 of the table top. Advantageously, this may facilitate positioning of the tables 2 next to each other, stacking of the tables, storage of the tables and shipping of the tables.

Figure 11:
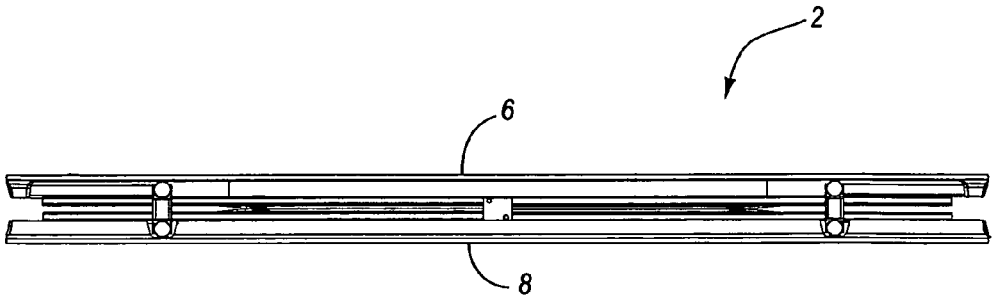
FIG. 11 is a top view of the table shown in FIG. 9.
Figure 12:
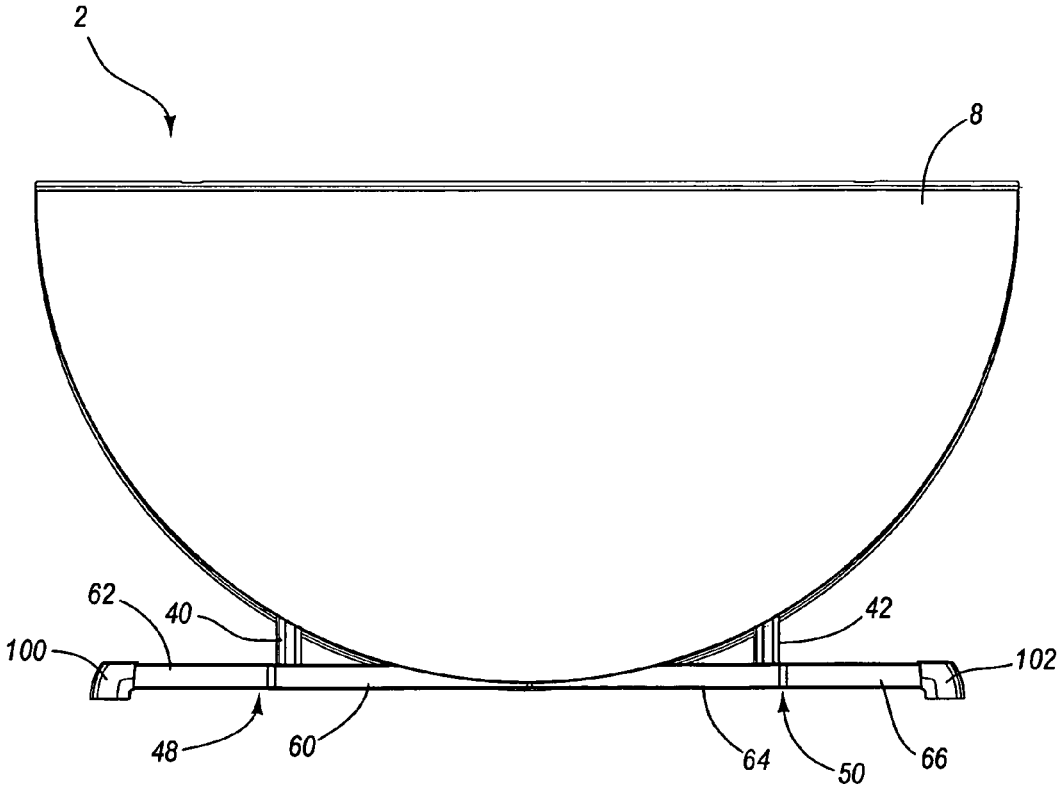
FIG. 12 is a front view of the table shown in FIG. 9.
Figure 14:
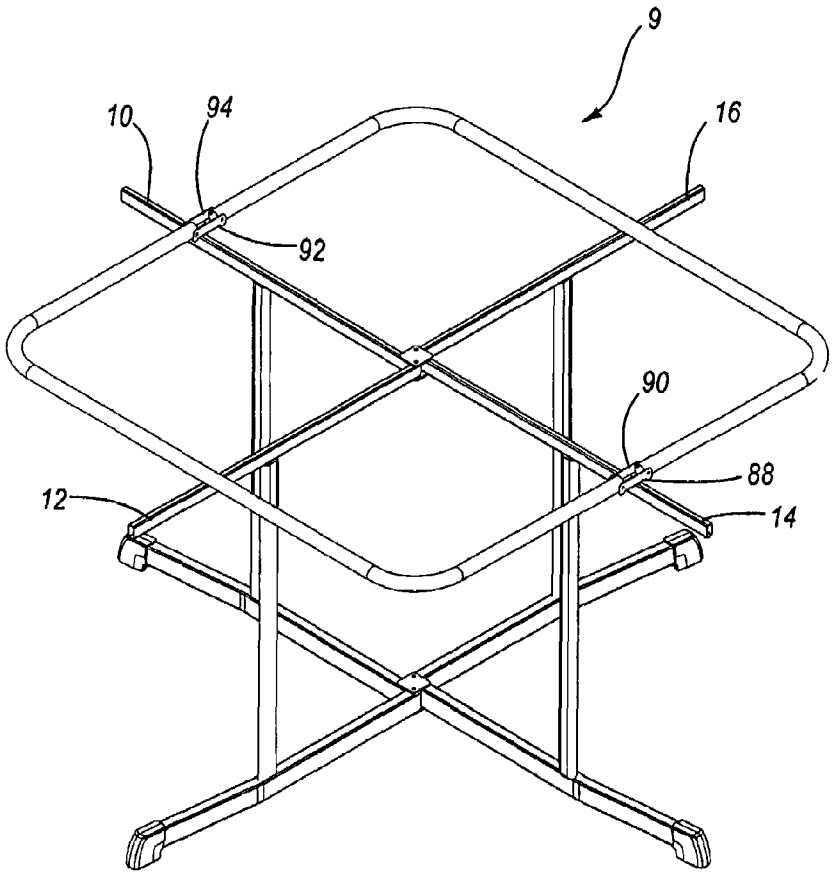
FIG. 14 is another top perspective view of the frame shown in FIG. 13.
Figure 13:
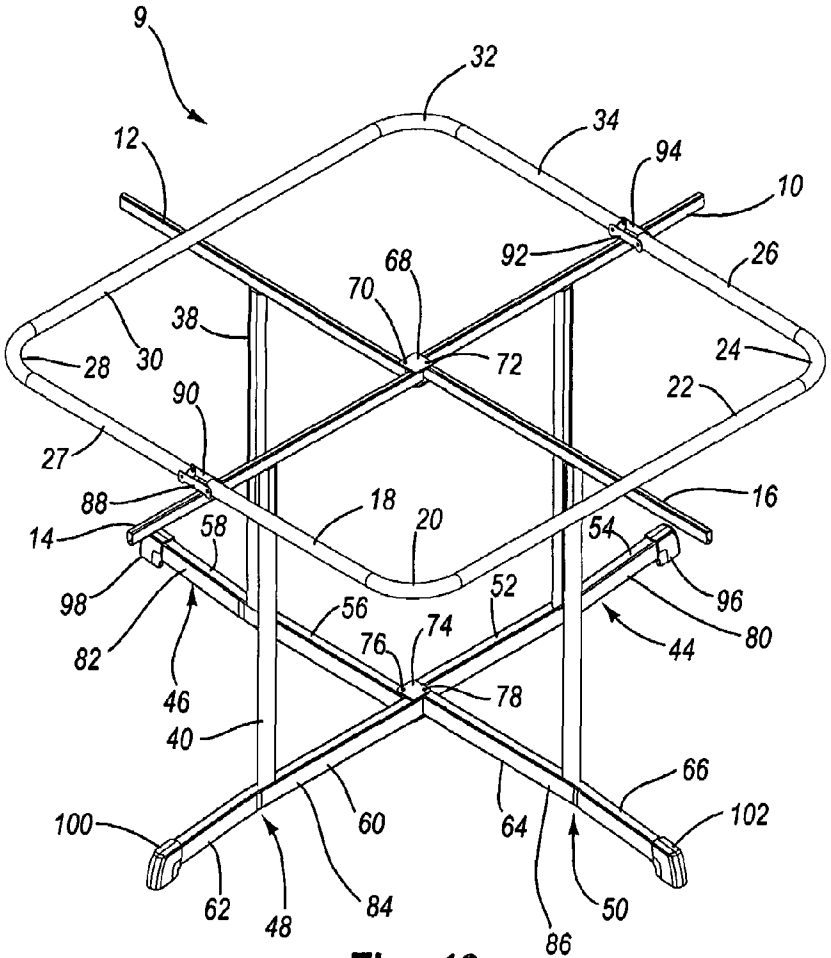
FIG. 13 is a top perspective view of an exemplary embodiment of a frame, illustrating the frame being sized and configured to support two sections of a table top in the extended positions.
Figure 15:
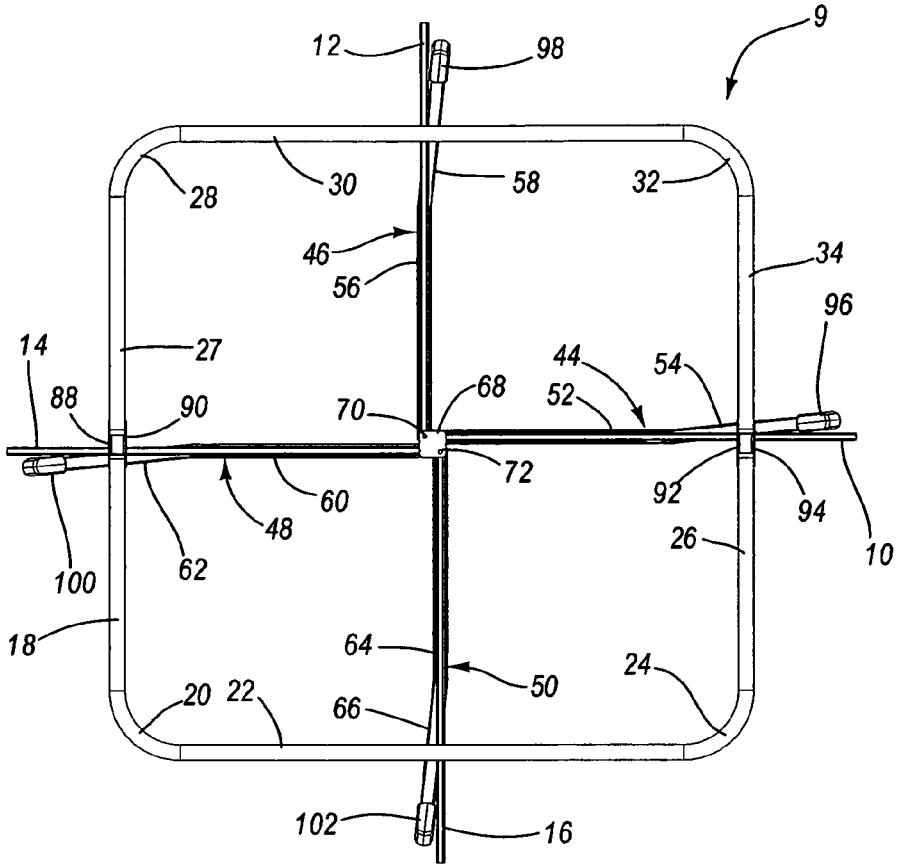
FIG. 15 is a top view of the frame shown in FIG. 13.
Figure 16:
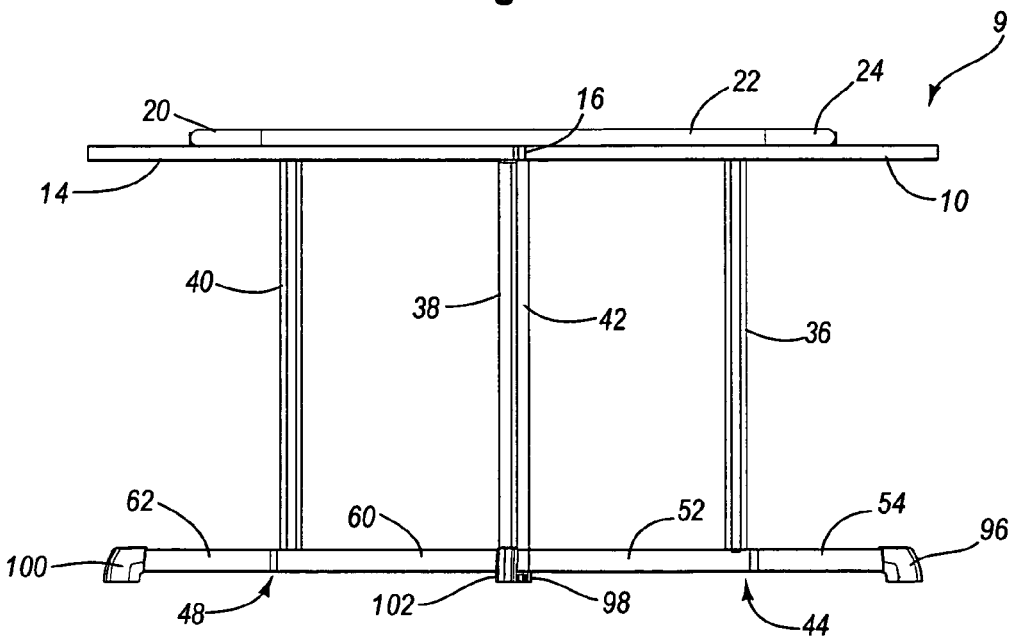
FIG. 16 is a front view of the frame shown in FIG. 13.
Figure 18:
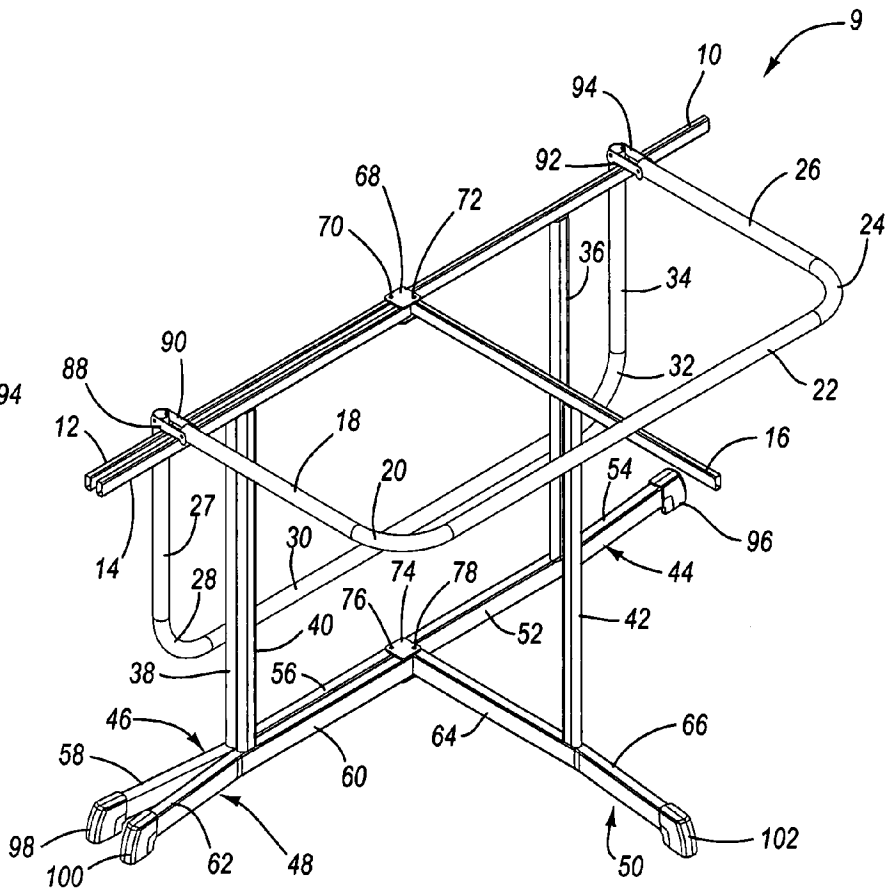
FIG. 18 is another top perspective view of the frame shown in FIG. 17.
Figure 17:
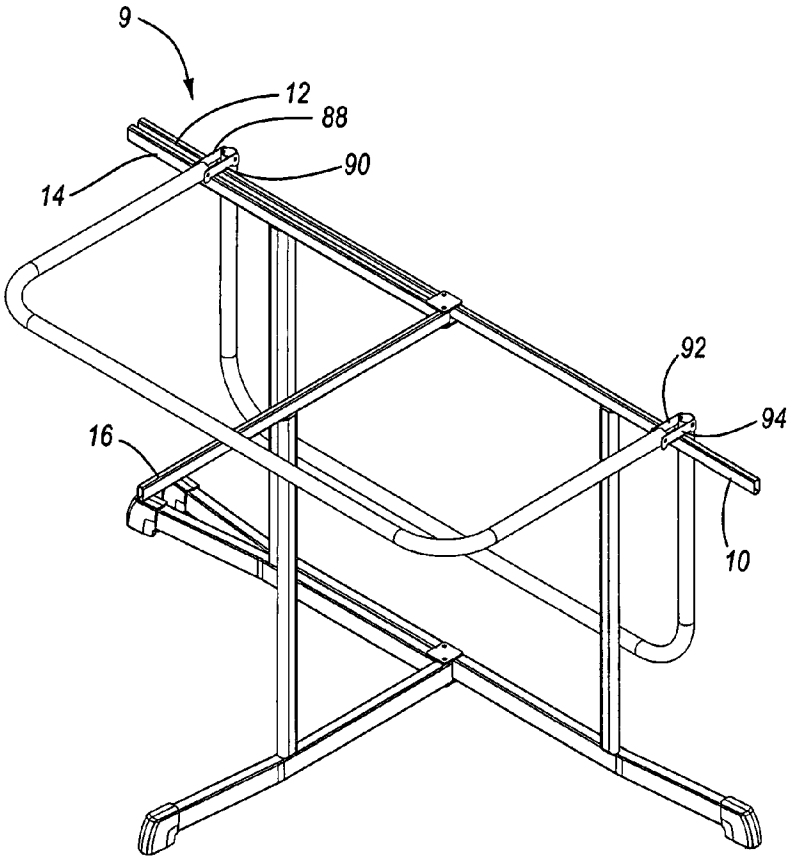
FIG. 17 is a top perspective view of the frame shown in FIG. 13, illustrating a first section of the frame being sized and configured to support a first section of the table top in the extended position and a second section of the frame being sized and configured to support a second section of the table top in the collapsed position.
Figure 19:
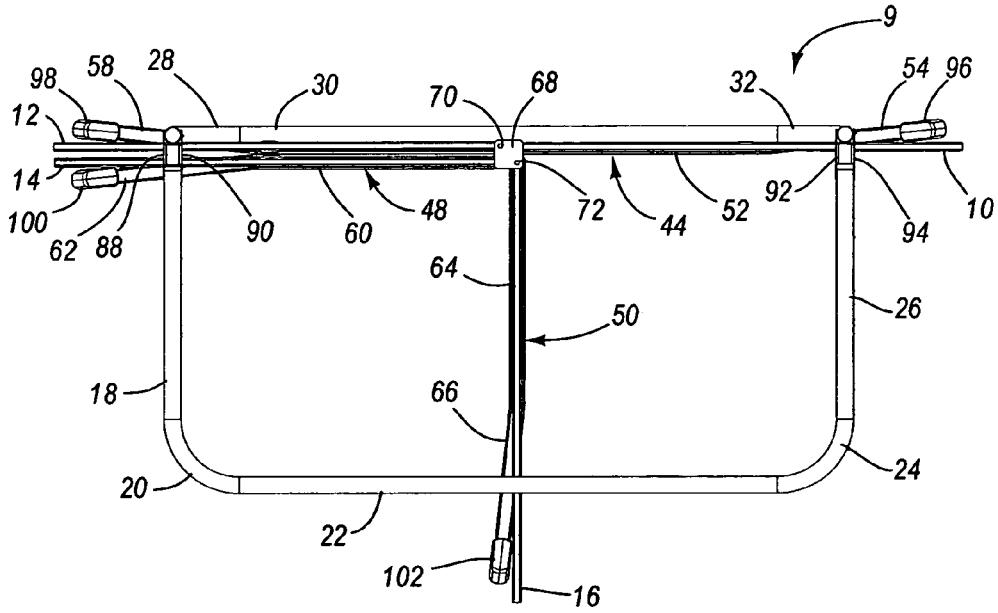
FIG. 19 is a top view of the frame shown in FIG. 17.
Figure 20:
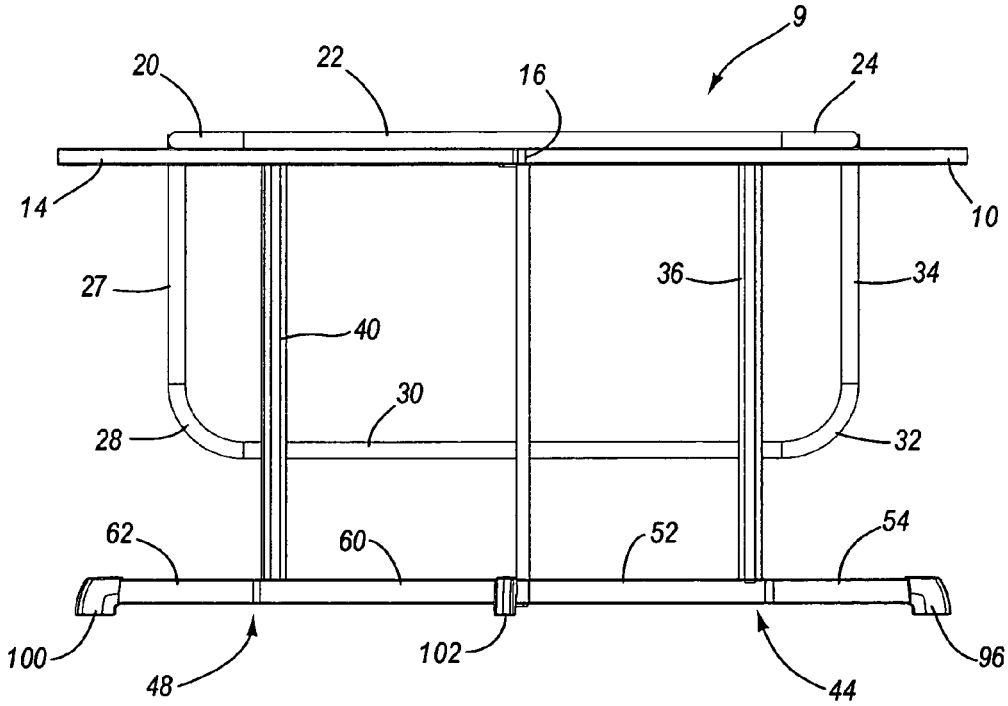
FIG. 20 is a front view of the frame shown in FIG. 17.
Figure 22:
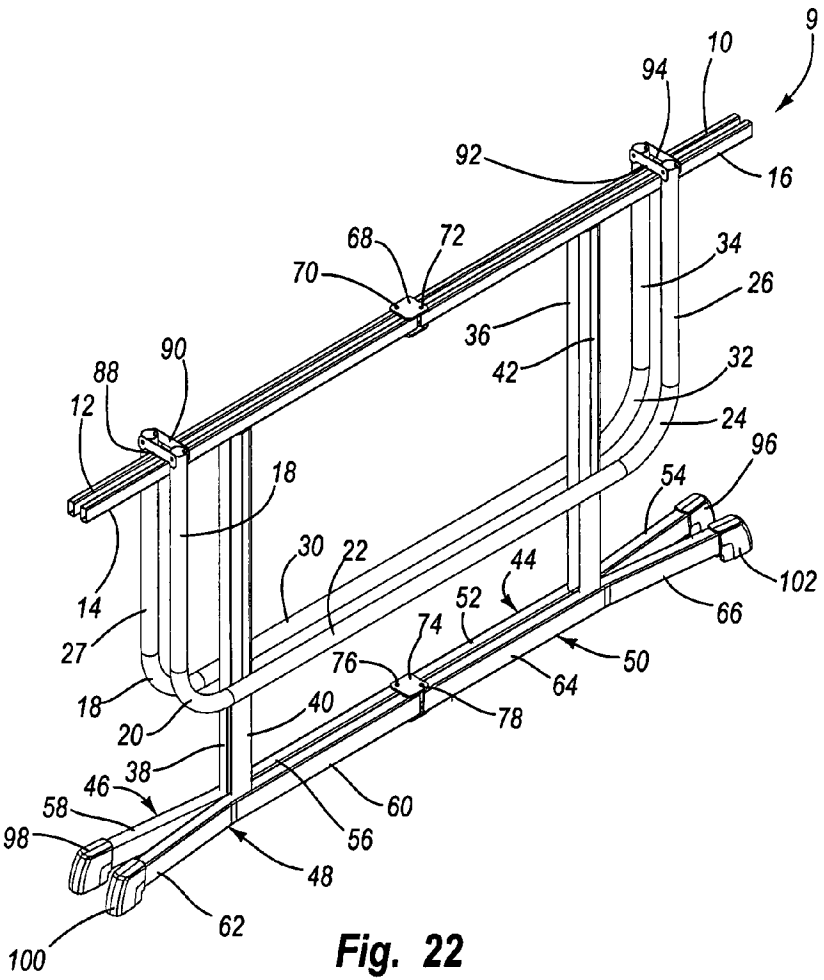
FIG. 22 is another top perspective view of the frame shown in FIG. 21.
Figure 21:
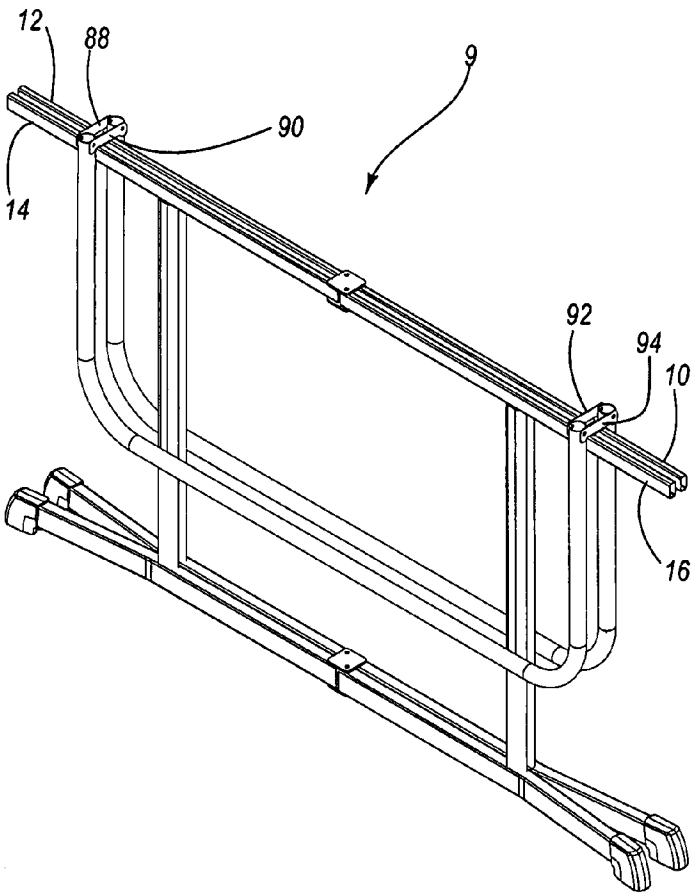
FIG. 21 is a top perspective view of the frame shown in FIG. 13, illustrating the first and second sections of the frame being sized and configured to support the first and second sections of the table top in the collapsed positions.
Figure 23:
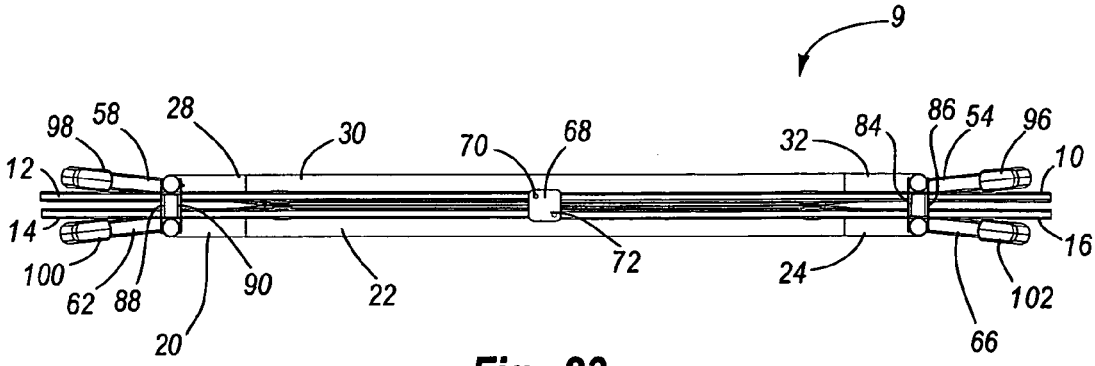
FIG. 23 is a top view of the frame shown in FIG. 21.
Figure 24:
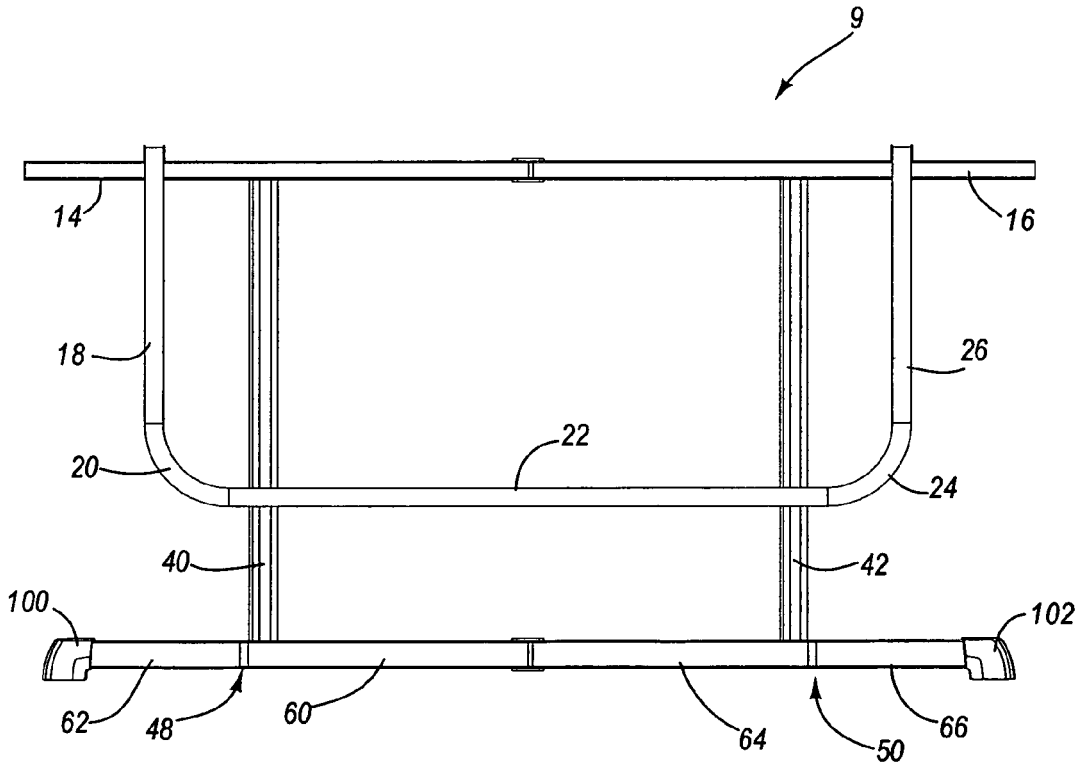
FIG. 24 is a front view of the frame shown in FIG. 21.

In greater detail, as shown in FIG. 11 for example, when the first and second sections 6, 8 of the table top 4 are in a collapsed position, the feet 44, 46, 48, 50 and/or the end caps 96, 98, 100, 102 are preferably disposed between a first plane generally aligned with the upper surface of the first table top section and a second plane generally aligned with the upper surface of the second table top portion. This may allow, for example, the table 2 to be positioned against a wall. It will be appreciated that all or a portion of the feet 44, 46, 48, 50 and/or the end caps 96, 98, 100, 102 may be disposed beyond these planes, if desired.

As shown in FIG. 11, when the first and second sections 6, 8 of the table top 4 are in a collapsed position, the pedestals 80, 82, 84, 86 are preferably disposed between the first plane generally aligned with the upper surface of the first table top section and the second plane generally aligned with the upper surface of the second table top section. This may also facilitate positioning of the tables 2 next to each other, stacking of the tables, storage of the tables, shipping of the tables and positioning the table against a wall. It will be appreciated that all or a portion of the pedestals 80, 82, 84, 86 may be disposed beyond these planes, if desired.

The first and second sections 6, 8 of the table top 4 may each include an inner edge that are sized and configured to be positioned proximate, abut or engage when the first and second sections are in the extended positions. The inner edges of the first and second sections 6, 8, however, may be spaced apart when one or both the table top sections 6, 8 are in the collapsed position. The inner edges of the table top sections 6, 8 may be sized and configured to engage, overlap and/or interlock to allow, for example, a secure connection of the table top sections 6, 8 when the table top 4 is in the extended or use position. For instance, the inner edges of the table top sections 6, 8 may include one or more projections and/or recesses that are sized and configured to contact or engage when the table top 4 is in the extended or use position. In particular, the inner edges may include tongue and groove portions that are sized and configured to engage when the first and second table top 4 sections 6, 8 are in the extended or use position. In greater detail, the inner edge of the first table top section 6 may include one or more tongue and/or groove portions that are aligned with corresponding tongue and/or groove portions in the inner edge of the second table top section 8. The table top sections 6, 8 are preferably configured so that the tongue and groove portions engage or interlock when the table top 4 is in the extended or use position. Advantageously, this may increase the strength and rigidity of the table top 4, which may allow the table top to be constructed of a lighter and/or thinner material without sacrificing strength or integrity. Additional details regarding the size, shape and configuration of projections and/or recesses that may suitable for use in connection with the table top 4 are disclosed in Assignee's pending U.S. patent application Ser. No. 10/843,037, which was filed May 10, 2004, entitled PORTABLE FOLDING TABLE WITH LOCKING HINGE, which is incorporated by reference in its entirety. While the table top 4 may include such projections and/or recesses, it will be appreciated that the table top does not require any projections, recesses, or the like.

Advantageously, the table 2 may be relatively simple and straightforward to use and operate. For example, as shown in FIGS. 1-4, the table 2 may be in an extended or use position in which the first and second sections 6, 8 of the table top 4 are in their extended or use positions. In addition, the pedestals 80, 82, 84, 86 are also in the extended or use position in which the pedestals are disposed in a generally perpendicular configuration. In this configuration, the second pedestal 82 preferably supports the first section 6 of the table top 4 and the fourth pedestal 86 preferably supports the second section 8 of the table top in the extended or use position.

As shown in FIGS. 5-8, a portion of the table 2 may be moved into the collapsed or folded position. For example, the second pedestal 82 may be moved from the extended position to the collapsed position in which second pedestal is disposed proximate to or adjacent the third pedestal 84. Preferably, the second pedestal 82 is pivoted from the extended position to the collapsed position and, because the second pedestal no longer supports the first section 6 of the table top 4, the first section of the table top can be moved from the extended position to the collapsed position. Advantageously, the second pedestal 82 and the first section 6 of the table top 4 may be moved between the extended and collapsed positions without requiring any latches, locks, fasteners and the like be released. One or more latches, locks, fasteners and the like, however, may be used to secure the second pedestal 82 and/or the first section 6 of the table top 4 in the extended and/or collapsed positions.

Significantly, while the first section 6 of the table top 4 is in the collapsed position, the second section 8 may remain in the extended position. Advantageously, this may allow the second section 8 to still be used if desired. For example, if only a portion of the table 2 is needed or the table is intended to be used in a small space, then a portion of the table top 4 may be disposed in the collapsed position while the other portion of the table top may be disposed in the extended position. Additionally, the table 2 is preferably sized and configured so that when a section of the table top 4 is disposed in the collapsed position, that section of the table top may be disposed against a wall. This may further facilitate using the table 2 in a relatively small space or increase the potential uses of the table.

As shown in FIGS. 9-12, both the first section 6 and the second section 8 of the table top 4 may be disposed in the collapsed positions. For example, the fourth pedestal 84 may be moved from the extended position to the collapsed position in which fourth pedestal is disposed proximate to or adjacent the first pedestal 80. Preferably, the fourth pedestal 84 is pivoted from the extended position to the collapsed position in a similar manner as the second pedestal 82. When the fourth pedestal 84 no longer supports the second section 8 of the table top 4, the second section of the table top can be moved from the extended position to the collapsed position. The fourth pedestal 84 and the second section 8 of the table top 4 may also be moved between the extended and collapsed positions without requiring any latches, locks, fasteners and the like be released, but latches, locks, fasteners and the like may be used to secure the fourth pedestal 86 and/or the second section 8 of the table top 4 in the extended and/or collapsed positions if desired.

In order to use the table 2, the first and/or second sections 6, 8 of the table top 4 may be moved into the extended positions and the corresponding pedestals 82, 86 may be moved into the extended positions. Significantly, the first and second sections 6, 8 and the pedestals 82, 86 may be quickly and easily moved between the extended and collapsed positions. In addition, it will be appreciated that the sections 6, 8 of the table top 8 and the pedestals 82, 86 may be moved in any appropriate sequence or order depending, for example, upon the intended use of the table 2.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top including a first section and a second section, the first section being selectively movable between a use position and a collapsed position, the second section being selectively movable between a use position and a collapsed position;

a first pedestal movable between a first position in which the first pedestal supports the first section of the table top in the use position and a second position in which the first section of the table top may be moved between the use position and the collapsed position, the first pedestal including an upper portion and a lower foot;

a second pedestal movable between a first position in which the second pedestal supports the second section of the table top in the use position and a second position in which the second section of the table top may be move between the use position and the collapsed position, the second pedestal including an upper portion and a lower foot;

a third pedestal that remains in a generally fixed position, the third pedestal including an upper portion and a lower foot;

a fourth pedestal that remains in a generally fixed position, the fourth pedestal including an upper portion and a lower foot;

a first bracket interconnecting the upper portion of the first pedestal, the upper portion of the second pedestal, the upper portion of the third pedestal and the upper portion of the fourth pedestal; and a second bracket interconnecting the foot of the first pedestal, the foot of the second pedestal, the foot of the third pedestal and the foot of the fourth pedestal.

2. The table as in claim 1, wherein the first bracket is pivotally connected to the upper portion of the first pedestal and the upper portion of the second pedestal; and wherein the second bracket is pivotally connected to the foot of the first pedestal and the foot of the second pedestal.

3. The table as in claim 1, wherein the first bracket, the upper portion of the third pedestal and the upper portion of the fourth pedestal are interconnected and generally aligned in a straight line when the first and second sections of the table top are in the use or collapsed positions.

4. The table as in claim 1, wherein the first pedestal is generally aligned with the second pedestal when the first pedestal is in the first position and when the second pedestal is in the first position; and wherein the first pedestal is generally aligned with the second pedestal when the first pedestal is in the second position and when the second pedestal is in the second position.

5. The table as in claim 1, wherein the first pedestal is disposed at an angle relative to the third pedestal when the first pedestal is in the first position;

wherein the first pedestal is disposed generally parallel to the third pedestal when the first pedestal is in the second position;

wherein the second pedestal is disposed at an angle relative to the fourth pedestal when the second pedestal is in the first position; and wherein the second pedestal is disposed generally parallel to the fourth pedestal when the second pedestal is in the second position.

6. The table as in claim 1, wherein the first pedestal can be disposed in the second position and the first section of the table top can be disposed in the collapsed position while the second pedestal is in the first position and the second section of the table top is in the use position.

7. The table as in claim 1, wherein when the first section of the table top and the second section of the table top are in the collapsed positions, a portion of the first pedestal, the second pedestal, the third pedestal and the fourth pedestal extend beyond an outer perimeter of the table top to support the table in the collapsed position.

8. The table as in claim 7, wherein when the first section of the table top and the second section of the table top are in the collapsed positions, the first pedestal, the second pedestal, the third pedestal and the fourth pedestal are generally disposed between a plane generally aligned an upper surface of the first section of the table top and a plane generally aligned with an upper surface of the second section of the table top to facilitate storage of the table.

9. The table as in claim 1, wherein each foot of the first pedestal, the second pedestal, the third pedestal and the fourth pedestal includes an elongated portion that is disposed generally parallel to a support surface, each elongated portion including a first section and an offset second section, the offset second section being sized and configured to create a stable support for the table when the first section of the table top and the second section of the table top are in the collapsed positions.

10. The table as in claim 9, wherein when the first section of the table top and the second section of the table top are in the collapsed positions, each foot of the first pedestal, the second pedestal, the third pedestal and the fourth pedestal is generally disposed between a plane generally aligned an upper surface of the first section of the table top and a plane generally aligned with an upper surface of the second section of the table top to facilitate storage of the table.

11. The table as in claim 1, wherein the first section of the table top is constructed from blow molded plastic and includes a hollow interior portion that is formed during the blow-molding process; and wherein the second section of the table top is constructed from blow molded plastic and includes a hollow interior portion that is formed during the blow-molding process.

12. A table comprising:

a table top including a first section that is selectively movable between a use position and a collapsed position and a second section that is selectively movable between a use position and a collapsed position, the first section being generally aligned in the same plane with the second section when the first section and the second section are in the use positions, the first section being generally disposed parallel and adjacent to the second section when the first section and the second section are in the collapsed positions;

a first pedestal movable between a first position in which the first pedestal supports the first section of the table top in the use position and a second position in which the first section of the table top may move between the use position and the collapsed position, the first pedestal comprising:

an upper portion;

a leg; and an elongated foot including a first section and an offset second section;

a second pedestal movable between a first position in which the second pedestal supports the second section of the table top in the use position and a second position in which the second section of the table top may move between the use position and the collapsed position; the second pedestal comprising:

an upper portion;

a leg; and an elongated foot including a first section and an offset second section;

a third pedestal that remains is a generally fixed position relative to the table top, the third pedestal comprising:

an upper portion;

a leg; and an elongated foot including a first section and an offset second section;

and a fourth pedestal that remains in a generally fixed position relative to the table top, the fourth pedestal comprising:

an upper portion;

a leg; and an elongated foot including a first section and an offset second section.

13. The table as in claim 12, wherein the first pedestal is disposed proximate the third pedestal when the first section of the table top is in the collapsed position, the first section of the foot of the first pedestal being disposed generally parallel to the first section of the foot of the third pedestal, the second section of the foot of the first pedestal being angled outwardly from the second section of the foot of the third pedestal to help support the table when the first section of the table top is in the collapsed position; and wherein the second pedestal is disposed proximate the fourth pedestal when the second section of the table top is in the collapsed position, the first section of the foot of the second pedestal being disposed generally parallel to the first section of the foot of the fourth pedestal, the second section of the foot of the second pedestal being angled outwardly from the second section of the foot of the fourth pedestal to help support the table when the second section of the table top is in the collapsed position.

14. The table as in claim 12, wherein the first pedestal can be disposed in the second position and the first section of the table top can be disposed in the collapsed position while the second pedestal is in the first position and the second section of the table top is in the use position.

15. The table as in claim 12, wherein when the first section of the table top and the second section of the table top are in the collapsed positions, the first pedestal, the second pedestal, the third pedestal and the fourth pedestal are at least substantially disposed between a plane generally aligned with an upper surface of the first section of the table top and a plane generally aligned with an upper surface of the second section of the table top to facilitate storage of the table.

16. The table as in claim 12, wherein the offset second section of the foot of each of the pedestals is sized and configured to create a stable support for the table when the first section of the table top and the second section of the table top are in the collapsed positions.

17. The table as in claim 12, wherein when the first section of the table top and the second section of the table top are in the collapsed positions, the foot of each of the pedestals is at least substantially disposed between a plane generally aligned an upper surface of the first section of the table top and a plane generally aligned with an upper surface of the second section of the table top to facilitate storage of the table.

18. The table as in claim 12, further comprising a first bracket interconnecting the upper portion of the first pedestal, the upper portion of the second pedestal, the upper portion of the third pedestal and the upper portion of the fourth pedestal; and a second bracket interconnecting the foot of the first pedestal, the foot of the second pedestal, the foot of the third pedestal and the foot of the fourth pedestal.

19. The table as in claim 12, further comprising a first support portion connected to the first section of the table top and a second support portion connected to the second section of the table top, a portion of the first support portion being disposed between the first pedestal and the first section of the table top when the first pedestal supports the first section of the table top in the use position, a portion of the second support portion being disposed between the second pedestal and the second section of the table top when the second pedestal supports the second section of the table top in the use position.

20. The table as in claim 19, wherein the first support portion and the second support portion are pivotally connected.

21. A table comprising:

a table top including a first section that is selectively movable between a use position and a collapsed position and a second section that is selectively movable between a use position and a collapsed position, the first section being generally aligned in the same plane with the second section when the first section and the second section are in the use positions, the first section being generally disposed parallel and adjacent to the second section when the first section and the second section are in the collapsed positions;

a first pedestal movable between a first position in which the first pedestal supports the first section of the table top in the use position and a second position in which the first section of the table top may move between the use position and the collapsed position, the first pedestal comprising:

an upper portion;

a leg; and an elongated foot;

a second pedestal movable between a first position in which the second pedestal supports the second section of the table top in the use position and a second position in which the second section of the table top may move between the use position and the collapsed position; the second pedestal comprising:

an upper portion;

a leg; and an elongated foot;

a third pedestal connected to the table top, the third pedestal comprising:

an upper portion;

a leg; and an elongated foot;

a fourth pedestal connected to the table top, the fourth pedestal comprising:

an upper portion;

a leg; and an elongated foot;

a first bracket interconnecting the upper portion of the first pedestal, the upper portion of the second pedestal, the upper portion of the third pedestal and the upper portion of the fourth pedestal; and a second bracket interconnecting the foot of the first pedestal, the foot of the second pedestal, the foot of the third pedestal and the foot of the fourth pedestal;

wherein the elongated foot of the first pedestal includes a first section and an offset second section, the elongated foot of the second pedestal includes a first section and an offset second section, the elongated foot of the third pedestal includes a first section and an offset second section, and the elongated foot of the fourth pedestal includes a first section and an offset second section;

wherein the first pedestal is disposed proximate the third pedestal when the first section of the table top is in the collapsed position, the first section of the foot of the first pedestal being disposed generally parallel to the first section of the foot of the third pedestal, the second section of the foot of the first pedestal being angled outwardly from the second section of the foot of the third pedestal to help support the table when the first section of the table top is in the collapsed position; and wherein the second pedestal is disposed proximate the fourth pedestal when the second section of the table top is in the collapsed position, the first section of the foot of the second pedestal being disposed generally parallel to the first section of the foot of the fourth pedestal, the second section of the foot of the second pedestal being angled outwardly from the second section of the foot of the fourth pedestal to help support the table when the second section of the table top is in the collapsed position.

22. The table as in claim 21, wherein the offset second section of the foot of each of the pedestals is sized and configured to create a stable support for the table when the first section of the table top and the second section of the table top are in the collapsed positions.

23. The table as in claim 21, wherein when the first section of the table top and the second section of the table top are in the collapsed positions, the foot of each of the pedestals is at least substantially disposed between a plane generally aligned an upper surface of the first section of the table top and a plane generally aligned with an upper surface of the second section of the table top to facilitate storage of the table.

24. A table comprising:

a table top including a first section that is selectively movable between a use position and a collapsed position and a second section that is selectively movable between a use position and a collapsed position, the first section being generally aligned in the same plane with the second section when the first section and the second section are in the use positions, the first section being generally disposed parallel and adjacent to the second section when the first section and the second section are in the collapsed positions;

a first pedestal movable between a first position in which the first pedestal supports the first section of the table top in the use position and a second position in which the first section of the table top may move between the use position and the collapsed position, the first pedestal comprising:

an upper portion;

a leg; and an elongated foot;

a second pedestal movable between a first position in which the second pedestal supports the second section of the table top in the use position and a second position in which the second section of the table top may move between the use position and the collapsed position; the second pedestal comprising:

an upper portion;

a leg; and an elongated foot;

a third pedestal connected to the table top, the third pedestal comprising:

an upper portion;

a leg; and an elongated foot;

a fourth pedestal connected to the table top, the fourth pedestal comprising:

an upper portion;

a leg; and an elongated foot;

a first bracket interconnecting the upper portion of the first pedestal, the upper portion of the second pedestal, the upper portion of the third pedestal and the upper portion of the fourth pedestal;

a second bracket interconnecting the foot of the first pedestal, the foot of the second pedestal, the foot of the third pedestal and the foot of the fourth pedestal; and a first support portion connected to the first section of the table top and a second support portion connected to the second section of the table top, a portion of the first support portion being disposed between the first pedestal and the first section of the table top when the first pedestal supports the first section of the table top in the use position, a portion of the second support portion being disposed between the second pedestal and the second section of the table top when the second pedestal supports the second section of the table top in the use position.

25. The table as in claim 24, wherein the first support portion and the second support portion are pivotally connected.

* * * * *

UNITED STATES PATENT AND TRADEMARK OFFICE

CERTIFICATE OF CORRECTION

PATENT NO. : 7,299,753 B2
APPLICATION NO. : 11/142017
DATED : November 27, 2007
INVENTOR(S) : L. Curtis Strong It is certified that error appears in the above-identified patent and that said Letters Patent is hereby corrected as shown below:

Column 1
Line 44, change “table” to --tables--

Column 3
Line 46, change “is table” to --is a table--

Column 12
Line 52, change “top 4 sections” to --top sections--

Column 13
Line 52, change “84” to --86--
Line 56, change “84” to --86--
Line 58, change “84” to --86--
Line 61, change “84” to --86--

Column 14
Line 34, change “move” to --moved--

Signed and Sealed this

Twenty-second Day of July, 2008

JON W. DUDAS
*Director of the United States Patent and Trademark Office*